US008546312B2

(12) United States Patent
Tagawa

(10) Patent No.: US 8,546,312 B2
(45) **Date of Patent: *Oct. 1, 2013**

(54) LUBRICANT OIL COMPOSITION FOR INTERNAL COMBUSTION ENGINE

(75) Inventor: Kazuo Tagawa, Yokohama (JP)

(73) Assignee: JX Nippon Oil & Energy Corporation, Tokyo (JP)

( * ) Notice: Subject to any disclaimer, the term of this patent is extended or adjusted under 35 U.S.C. 154(b) by 167 days.

This patent is subject to a terminal disclaimer.

(21) Appl. No.: 12/934,374

(22) PCT Filed: Mar. 23, 2009

(86) PCT No.: PCT/JP2009/055667

§ 371 (c)(1),
(2), (4) Date: Nov. 18, 2010

(87) PCT Pub. No.: WO2009/119506

PCT Pub. Date: Oct. 1, 2009

(65) Prior Publication Data

US 2011/0065618 A1 Mar. 17, 2011

(30) Foreign Application Priority Data

Mar. 25, 2008 (JP) ..... P2008-078224

(51) Int. Cl.
*C10M 135/30* (2006.01)
*C10M 135/22* (2006.01)
*C10M 113/08* (2006.01)

(52) U.S. Cl.
USPC ..... 508/382; 508/569; 508/572

(58) Field of Classification Search
USPC ..... 508/382, 569, 572
See application file for complete search history.

(56) References Cited

U.S. PATENT DOCUMENTS

| | | | | |
|---|---|---|---|---|
| 2,861,941 | A | 11/1958 | Jancosek et al. | |
| 2,890,161 | A | 6/1959 | Brown et al. | |
| 3,078,222 | A | 2/1963 | Henke et al. | |
| 3,847,790 | A | 11/1974 | Putz | |
| 4,021,357 | A | 5/1977 | Morduchowitz et al. | |
| 4,867,894 | A | 9/1989 | Pennewiss et al. | |
| 5,282,958 | A | 2/1994 | Santilli et al. | |
| 5,362,378 | A | 11/1994 | Borghard et al. | |
| 5,652,201 | A * | 7/1997 | Papay et al. | 508/228 |
| 5,763,374 | A | 6/1998 | Sakai et al. | |
| 5,955,405 | A | 9/1999 | Liesen et al. | |
| 6,077,455 | A | 6/2000 | Bloch et al. | |
| 6,090,989 | A | 7/2000 | Trewella et al. | |
| 6,383,366 | B1 | 5/2002 | Riley et al. | |
| 6,602,402 | B1 | 8/2003 | Benazzi et al. | |
| 7,285,206 | B2 | 10/2007 | Germaine | |
| 7,867,957 | B2 * | 1/2011 | Matsui et al. | 508/192 |
| 2001/0056044 | A1 | 12/2001 | Kinker et al. | |
| 2002/0119896 | A1 | 8/2002 | Yagishita et al. | |
| 2003/0036488 | A1 | 2/2003 | Yuki et al. | |
| 2003/0104955 | A1 | 6/2003 | Yuki et al. | |
| 2003/0162673 | A1 | 8/2003 | Kurihara et al. | |
| 2003/0226785 | A1 | 12/2003 | Murphy et al. | |
| 2004/0045868 | A1 | 3/2004 | Germaine | |
| 2004/0065588 | A1 | 4/2004 | Genetti et al. | |
| 2004/0077509 | A1 | 4/2004 | Yuki et al. | |
| 2004/0079675 | A1 | 4/2004 | Germaine et al. | |
| 2004/0092409 | A1 | 5/2004 | Liesen | |
| 2004/0099571 | A1 | 5/2004 | Germaine et al. | |
| 2004/0108249 | A1 | 6/2004 | Cody et al. | |
| 2004/0112792 | A1 | 6/2004 | Murphy et al. | |
| 2004/0119046 | A1 | 6/2004 | Carey et al. | |
| 2004/0129603 | A1 | 7/2004 | Fyfe et al. | |
| 2004/0154957 | A1 | 8/2004 | Keeney et al. | |
| 2004/0154958 | A1 | 8/2004 | Alexander et al. | |
| 2004/0198616 | A1 | 10/2004 | Hirao et al. | |
| 2004/0224860 | A1 | 11/2004 | Baba et al. | |
| 2005/0077209 | A1 | 4/2005 | Miller et al. | |
| 2005/0221998 | A1 | 10/2005 | Marumo et al. | |
| 2006/0027486 | A1 | 2/2006 | Rosenbaum et al. | |
| 2006/0052252 | A1 | 3/2006 | Wedlock | |
| 2006/0172900 | A1 | 8/2006 | Yagishita et al. | |
| 2006/0205610 | A1 | 9/2006 | Rosenbaum et al. | |
| 2007/0032392 | A1 | 2/2007 | Yokoyama et al. | |
| 2007/0138032 | A1 | 6/2007 | Agarkov | |
| 2007/0138052 | A1 | 6/2007 | Kobayashi et al. | |
| 2007/0191239 | A1 | 8/2007 | Matsuoka et al. | |
| 2007/0238627 | A1 | 10/2007 | Haire et al. | |
| 2007/0287643 | A1 | 12/2007 | Matsui et al. | |
| 2008/0015400 | A1 | 1/2008 | Matsui et al. | |
| 2008/0029430 | A1 | 2/2008 | Loh et al. | |
| 2008/0029431 | A1 | 2/2008 | Alexander et al. | |
| 2008/0110799 | A1 | 5/2008 | Matsui et al. | |
| 2008/0248981 | A1 * | 10/2008 | Matsui et al. | 508/382 |
| 2009/0005278 | A1 | 1/2009 | Takeuchi et al. | |
| 2009/0075852 | A1 | 3/2009 | Yagishita et al. | |

(Continued)

FOREIGN PATENT DOCUMENTS

| | | |
|---|---|---|
| CA | 2 682 660 | 10/2008 |
| CN | 1279708 | 1/2001 |

(Continued)

OTHER PUBLICATIONS

Sharma et al., "Predicting Low Temperature Lubricant Rheology Using Nuclear Magnetic Resonance Spectroscopy and Mass Spectrometry", Tribology Letters, vol. 16, No. 1-2, Feb. 2004, pp. 11-19.

(Continued)

*Primary Examiner* — Jim Goloboy
(74) *Attorney, Agent, or Firm* — Greenblum & Bernstein, P.L.C.

(57) ABSTRACT

The lubricating oil composition for an internal combustion engine of the invention comprises a lubricating base oil having a urea adduct value of not greater than 4% by mass and a viscosity index of 100 or greater, an ash-free antioxidant containing no sulfur as a constituent element, and at least one compound selected from among ash-free antioxidants containing sulfur as a constituent element and organic molybdenum compounds.

3 Claims, No Drawings

(56) References Cited

U.S. PATENT DOCUMENTS

| | | | |
|---|---|---|---|
| 2009/0221461 | A1 | 9/2009 | Visger et al. |
| 2009/0312208 | A1 | 12/2009 | Ishikawa et al. |
| 2010/0016195 | A1 | 1/2010 | Shirahama et al. |
| 2010/0035777 | A1 | 2/2010 | Sano et al. |
| 2010/0041572 | A1 | 2/2010 | Sano et al. |
| 2010/0093578 | A1 | 4/2010 | Tsujimoto et al. |
| 2010/0130395 | A1 | 5/2010 | Tagawa et al. |
| 2010/0144571 | A1 | 6/2010 | Shirahama et al. |
| 2010/0190671 | A1 | 7/2010 | Stoehr et al. |
| 2011/0003725 | A1 | 1/2011 | Matsui et al. |
| 2011/0021394 | A1 | 1/2011 | Nakao et al. |
| 2011/0049008 | A1 | 3/2011 | Tagawa et al. |
| 2011/0049009 | A1 | 3/2011 | Tagawa et al. |
| 2011/0053815 | A1 | 3/2011 | Matsui et al. |
| 2011/0065618 | A1 | 3/2011 | Tagawa |
| 2011/0124536 | A1 | 5/2011 | Matsui |
| 2011/0218131 | A1 | 9/2011 | Tsujimoto et al. |
| 2011/0230685 | A1 | 9/2011 | Tagawa |
| 2011/0237477 | A1 | 9/2011 | Tagawa et al. |
| 2011/0306530 | A1 | 12/2011 | Manabe et al. |
| 2012/0071373 | A1 | 3/2012 | Matsui et al. |
| 2012/0071374 | A1 | 3/2012 | Yaguchi et al. |
| 2012/0071375 | A1 | 3/2012 | Yaguchi et al. |
| 2012/0135900 | A1 | 5/2012 | Matsui et al. |
| 2012/0157361 | A1 | 6/2012 | Mutou et al. |

FOREIGN PATENT DOCUMENTS

| | | | |
|---|---|---|---|
| CN | 1751115 | | 3/2006 |
| CN | 1317368 | C | 5/2007 |
| CN | 101065469 | | 10/2007 |
| CN | 101213277 | | 7/2008 |
| CN | 101426879 | | 5/2009 |
| EP | 1 749 876 | | 2/2007 |
| EP | 1 808 476 | | 7/2007 |
| EP | 1845151 | | 10/2007 |
| EP | 2 011 855 | | 8/2008 |
| EP | 2 009 074 | | 12/2008 |
| EP | 2 009 704 | | 12/2008 |
| EP | 2 011 854 | | 1/2009 |
| EP | 2 112 217 | | 10/2009 |
| EP | 2135928 | | 12/2009 |
| EP | 2241611 | | 10/2010 |
| EP | 2264131 | | 12/2010 |
| EP | 2264133 | | 12/2010 |
| EP | 2 319 908 | | 5/2011 |
| GB | 2407100 | | 4/2005 |
| JP | S30-000624 | | 2/1955 |
| JP | S31-003928 | | 5/1956 |
| JP | S45-019183 | | 7/1970 |
| JP | S48-025003 | | 4/1973 |
| JP | 63-223094 | A | 9/1988 |
| JP | S63-309592 | | 12/1988 |
| JP | 3-100099 | | 4/1991 |
| JP | 4-030391 | | 2/1992 |
| JP | 4-036391 | A | 2/1992 |
| JP | 4-068082 | | 3/1992 |
| JP | 4-120193 | | 4/1992 |
| JP | H5-508876 | | 12/1993 |
| JP | 6-145258 | | 5/1994 |
| JP | 6-306384 | | 11/1994 |
| JP | 7-048421 | | 2/1995 |
| JP | 7-062372 | | 3/1995 |
| JP | 8-183988 | | 7/1996 |
| JP | 8-302378 | A | 11/1996 |
| JP | 9-003463 | A | 1/1997 |
| JP | 2000-063439 | | 2/2000 |
| JP | 2000-63877 | | 2/2000 |
| JP | 2000-345170 | | 12/2000 |
| JP | 2000-345171 | | 12/2000 |
| JP | 2001-514301 | | 9/2001 |
| JP | 2001-279278 | | 10/2001 |
| JP | 2001-279287 | | 10/2001 |
| JP | 2002-503754 | A | 2/2002 |
| JP | 2002-503755 | | 2/2002 |
| JP | 2002-129182 | | 5/2002 |
| JP | 2002-521499 | | 7/2002 |
| JP | 2002-302687 | | 10/2002 |
| JP | 2004-10799 | | 1/2004 |
| JP | 2004-124080 | | 4/2004 |
| JP | 2004-169029 | | 6/2004 |
| JP | 2004-526831 | | 9/2004 |
| JP | 2004-528426 | | 9/2004 |
| JP | 2005-154760 | | 6/2005 |
| JP | 2005-171186 | | 6/2005 |
| JP | 2005-213447 | | 8/2005 |
| JP | 2005-290238 | | 10/2005 |
| JP | 2005-530902 | | 10/2005 |
| JP | 2006-502297 | A | 1/2006 |
| JP | 2006-502298 | A | 1/2006 |
| JP | 2006-045277 | | 2/2006 |
| JP | 2006-509899 | A | 3/2006 |
| JP | 2006-219642 | | 8/2006 |
| JP | 2006-518395 | A | 8/2006 |
| JP | 2006-241436 | | 9/2006 |
| JP | 2006-241437 | | 9/2006 |
| JP | 2006-521416 | A | 9/2006 |
| JP | 2006-274209 | | 10/2006 |
| JP | 2006-117851 | | 11/2006 |
| JP | 2006-117853 | | 11/2006 |
| JP | 2007-016172 | | 1/2007 |
| JP | 2007-045850 | | 2/2007 |
| JP | 2007-217494 | | 8/2007 |
| JP | 2007-246659 | | 9/2007 |
| JP | 2007-246661 | | 9/2007 |
| JP | 2007-246662 | | 9/2007 |
| JP | 2007-262239 | | 10/2007 |
| JP | 2007-269885 | | 10/2007 |
| JP | 2007-270059 | | 10/2007 |
| JP | 2007-270062 | | 10/2007 |
| JP | 2007-284635 | | 11/2007 |
| JP | 2007-297528 | | 11/2007 |
| JP | 2007-326963 | | 12/2007 |
| JP | 2008-013281 | | 1/2008 |
| JP | 2008-13681 | | 1/2008 |
| JP | 2008-013684 | | 1/2008 |
| JP | 2008-509244 | | 3/2008 |
| JP | 2008-120908 | | 5/2008 |
| JP | 2008-120909 | | 5/2008 |
| JP | 2008-184569 | | 8/2008 |
| JP | 2008-231189 | | 10/2008 |
| JP | 2008-231190 | | 10/2008 |
| JP | 2008-231191 | | 10/2008 |
| JP | 2008-274236 | A | 11/2008 |
| JP | 2008-274237 | A | 11/2008 |
| JP | 2008-274238 | A | 11/2008 |
| JP | 2008-303344 | A | 12/2008 |
| JP | 2009-096925 | | 5/2009 |
| JP | 2009-167278 | | 7/2009 |
| JP | 2009-074068 | | 9/2009 |
| JP | 2010-532805 | | 10/2010 |
| WO | 9603359 | | 2/1996 |
| WO | 99/41334 | | 8/1999 |
| WO | 02/070629 | | 9/2002 |
| WO | 2005/037967 | | 4/2005 |
| WO | 2005/090528 | | 9/2005 |
| WO | 2006/043709 | | 4/2006 |
| WO | 2007/001000 | | 1/2007 |
| WO | 2007/105769 | | 9/2007 |
| WO | 2007/114132 | | 10/2007 |
| WO | 2007/114260 | | 10/2007 |
| WO | 2007/116759 | | 10/2007 |
| WO | 2007/119299 | | 10/2007 |
| WO | 2007/123266 | | 11/2007 |
| WO | 2007/133999 | | 11/2007 |
| WO | 2008/072526 | | 6/2008 |
| WO | 2008/093446 | | 8/2008 |
| WO | 2008/123246 | A1 | 10/2008 |
| WO | 2008/123249 | A1 | 10/2008 |
| WO | 2009/007147 | | 1/2009 |
| WO | 2009/072524 | | 6/2009 |
| WO | 2009/090921 | | 7/2009 |
| WO | 2009/119505 | | 10/2009 |
| WO | 2010/041689 | | 4/2010 |
| WO | 2010/041692 | | 4/2010 |

OTHER PUBLICATIONS

E.P.O. Office action that issued with respect to patent family member European Patent Application No. 09723908.1, mail date is Mar. 2, 2012.
Shinya Sato et al., "Separation of n-Paraffin and 1-Olefin in Shale Oil by Urea Adduct Method", Sekiyu Gakkaishi, vol. 39, No. 5, 1996, pp. 365-368 with partial English language translation.
Japanese Notice of Information Provision issued in counterpart Japanese Patent Application No. 2008-078224, mailed May 15, 2012.
"The Advent of Modern Hydroprocessing—The Evolution of Base Oil Technology—Part 2", Machinery Lubirication (Retrieved from: http://www.machinerylubrication.com/Read/493/base-oil-technology on May 14, 2012), May 1, 2003, XP55027093.
Search report from E.P.O. that issued with respect to European Patent Application No. 09819126.5, mailed May 23, 2012.
Search report from E.P.O. that issued with respect to European Patent Application No. 09819223.0, mailed May 23, 2012.
Notification of Information Provision issued with respect to Japanese Patent Application No. 2009-135369, mailed May 29, 2012.
Notification of Information Provision issued with respect to Japanese Patent Application No. 2009-135444, mailed Jun. 19, 2012.
Search report from E.P.O. that issued with respect to patent family member European Patent Application No. 09723908.1, mail date is Jun. 29, 2011.
English-language translation of International Preliminary Report on Patentability for PCT/JP2009/0067163, mailed May 26, 2011.
English-language translation of International Preliminary Report on Patentability for PCT/JP2009/067504, mailed May 26, 2011.
English-language translation of International Preliminary Report on Patentability for PCT/JP2009/067509, mailed May 26, 2011.
English-language translation of International Preliminary Report on Patentability for PCT/JP2010/050916, mailed Jan. 26, 2012.
English-language translation of International Preliminary Report on Patentability for PCT/JP2010/050921, mailed Jan. 26, 2012.
English-language translation of International Preliminary Report on Patentability for PCT/JP2010/057957, mailed Jan. 26, 2012.
English-language translation of International Preliminary Report on Patentability for PCT/JP2010/059196, mailed Jan. 26, 2012.
English-language translation of International Preliminary Report on Patentability for PCT/JP2010/064698, mailed Mar. 29, 2012.
International Search Report for PCT/JP2009/0067504, mailed Dec. 28, 2009.
International Search Report for PCT/JP2010/050916, mailed Apr. 13, 2010.
International Search Report for PCT/JP2010/050921, mailed Apr. 6, 2010.
International Search Report for PCT/JP2010/057957, mailed Aug. 17, 2010.
International Search Report for PCT/JP2010/059196, mailed Aug. 31, 2010.
International Search Report for PCT/JP2010/064698 (English and Japanese) , mailed Nov. 2, 2010.
English-language translation of International Preliminary Report on Patentability for PCT/JP2009/050233, mailed Jul. 29, 2010.
J.P.O. Notification of Information Provision issued with respect to Japanese Patent Application No. 2008-261070, mailed Jun. 26, 2012.
E.P.O. Search Report issued with respect to European Patent Application No. 09819226.3, mailed Jun. 21, 2012.
J.P.O. Notification of Information Provision issued with respect to Japanese Patent Application No. 2008-078570, mailed May 22, 2012.
E.P.O. Search Report issued with respect to European Patent Application No. 09701700.8, mailed Jul. 5, 2012.
Search Report issued with respect to European Patent Application No. 12002743.8, mailed Aug. 16, 2012.
Search Report issued with respect to European Patent Application No. 12002744.6, mailed Aug. 16, 2012.
Office Action issued with respect to Indonesian Patent Application No. W00201003649, mailed Aug. 23, 2012.
Office Action issued with respect to U.S. Appl. No. 12/812,524, mailed Aug. 28, 2012.
U.S. Appl. No. 12/812,524 to Shigeki Matsui et al., which application is the National Stage of PCT/JP2009/050233 filed Jan. 9, 2009.
U.S. Appl. No. 12/865,921 to Kazuaki Hayasaka, which application is the National Stage of PCT/JP2009/051906 filed on Feb. 4, 2009.
U.S. Appl. No. 12/933,805 to Hajime Nakao et al., which application is the National Stage of PCT/JP2009/054778 filed on Mar. 12, 2009.
U.S. Appl. No. 12/934,431 to Kazuo Tagawa et al., which application is the National Stage of PCT/JP2009/055666 filed on Mar. 23, 2009.
U.S. Appl. No. 12/934,472 to Kazuo Tagawa et al., which application is the National Stage of PCT/JP2009/055690 filed on Mar. 23, 2009.
International Search Report for PCT/JP2009/055667, mailed Jun. 16, 2009.
International Preliminary Report on Patentability for PCT/JP2009/055667, mailed Nov. 18, 2010.
Abstract for WO 99/41334, corresponding to JP 2002-503754, published Feb. 5, 2002.
Office Action issued with respect to Chinese Patent Application No. 200980149130.9, mailed Dec. 4, 2012.
Office Action issued with respect to Chinese Patent Application No. 201080024425.6, mailed Dec. 12, 2012.
Office Action issued with respect to Chinese Patent Application No. 201080024832.7, mailed Dec. 12, 2012.
Office Action issued with respect to U.S. Appl. No. 13/122,828, mailed Feb. 28, 2013.
Office Action issued with respect to U.S. Appl. No. 13/122,622, mailed Mar. 22, 2013.
Office Action issued with respect to U.S. Appl. No. 12/812,524, mailed Jan. 22, 2013.
Hiroshi Ohtsuka et al., "Separation of Straight-Chain Hydrocarbons from Petroleum Fractions by Means of Urea—Adduct Formation", Bulletin of the Faculty of Engineering, Hokkaido University, 40, Mar. 30, 1966, pp. 125-137, along with a partial English-language translation.
Yozo Oshima et al., "Monomethylparaffins in n-Paraffins Adducted from Petroleum Fractions", Sekiyu Gakkaishi, vol. 18, No. 6, 1975, pp. 497-502, along with a partial English-language translation.
Notification of Information Provision issued with respect to Japanese Patent App. No. 2008-261079, mailed Mar. 12, 2013.
Office Action issued with respect to Chinese Patent Application No. 200980110123.8, mailed Apr. 1, 2013.
Schiessler et al., "Urea and Thiourea Adduction of $C_5$-$C_{42}$ -Hydrocarbons", *Journal of the American Chemical Society*, vol. 74, No. 7, pp. 1720-1723, Apr. 5, 1952.
Japanese Office Action issued with respect to Japanese Patent Application No. 2008-261079, dated May 21, 2013.
Office Action issued with respect to European Patent Application No. 09723908.1, mailed Sep. 12, 2012.
Rowe et al., "Low-Temperature Performance Advantages for Oils Using Hydrodewaxed Base Stocks", SAE Technical Paper Series 831715, Jan. 1, 1983, pp. 1-14.
Speight, "Hydrocarbons from Petroleum", Handbook of Industrial Hydrocarbon Processes, Jan. 1, 2011, pp. 85-126.
Search Report issued with respect to European Patent Application No. 10783230.5, mailed Feb. 11, 2013.
Search Report issued with respect to European Patent Application No. 12008549.3, mailed Feb. 11, 2013.
Notification of Information Provision issued with respect to Japanese Patent App. No. 2008-006024, mailed May 14, 2013.
Office Action issued with respect to Chinese Patent Application No. 200980110123.8, mailed Aug. 31, 2012.
Office Action issued with respect to Chinese Patent Application No. 200980110437.8, mailed Aug. 31, 2012.
Zimmerschied et al., "Crystalline Adducts of Urea with Linear Aliphatic Compounds", Industrial and Engineering Chemistry 42(7), Jul. 31, 1950, pp. 1300-1306.
Search Report issued with respect to European Patent Application No. 10783178.6, mailed Oct. 29, 2012.
English-language translation of International Preliminary Report on Patentability issued with respect to PCT/JP2009/055666, mailed Nov. 18, 2010.
English-language translation of International Preliminary Report on Patentability issued with respect to PCT/JP2009/055690, mailed Nov. 18, 2010.

Notification of Information Provision issued with respect to Japanese Patent Application No. 2008-261071, mailed Oct. 9, 2012.
Notification of Information Provision issued with respect to Japanese Patent Application No. 2008-261079, mailed Oct. 9, 2012.
Office Action issued with respect to Japanese Patent Application No. 2008-006024, mailed Dec. 4, 2012.
Japanese Office Action issued with respect to Japanese Patent Application No. 2008-261070, dated Jul. 2, 2013.
Japanese Office Action issued with respect to Japanese Patent Application No. 2009-135369, dated Jul. 16, 2013.

* cited by examiner

LUBRICANT OIL COMPOSITION FOR INTERNAL COMBUSTION ENGINE

TECHNICAL FIELD

The present invention relates to a lubricant oil composition for an internal combustion engine, and specifically it relates to a lubricant oil composition for an internal combustion engine which is suitable as a lubricant oil for a gasoline engine for a two-wheel vehicle, a four-wheel vehicle, electric power generation, a marine vessel or the like, or for a diesel engine, oxygen-containing compound-containing fuel adapted engine, gas engine or the like.

BACKGROUND ART

Lubricating oils used in internal combustion engines such as automobile engines require heat and oxidation stability that allows them to withstand harsh conditions for prolonged periods. Base oils with high viscosity indexes have been desired in recent years from the standpoint of achieving fuel savings, and various additives and base oils have been investigated. For example, it is common to include, as additives in base oils, peroxide-decomposable sulfur-containing compounds such as zinc dithiophosphate or molybdenum dithiocarbaminate, or ash-free antioxidants such as phenol-based or amine-based antioxidants (for example, see Patent documents 1-4).

Known processes for improving the viscosity-temperature characteristic/low-temperature viscosity characteristic and thermal oxidation stability include processes in which feedstock oils containing natural or synthetic normal paraffins are subjected to hydrocracking/hydroisomerization to produce high-viscosity-index base oils (see Patent documents 5-6, for example). Methods for improving the low-temperature viscosity characteristics of lubricating oils also exist, wherein additives such as pour point depressants are added to highly refined mineral oil-based base oils.

[Patent document 1] Japanese Unexamined Patent Application Publication HEI No. 4-36391

[Patent document 2] Japanese Unexamined Patent Application Publication SHO No. 63-223094

[Patent document 3] Japanese Unexamined Patent Application Publication HEI No. 8-302378

[Patent document 4] Japanese Unexamined Patent Application Publication HEI No. 9-003463

[Patent document 5] Japanese Patent Public Inspection No. 2006-502298

[Patent document 6] Japanese Patent Public Inspection No. 2002-503754

DISCLOSURE OF THE INVENTION

Problems to be Solved by the Invention

Recently, in consideration of increasingly harsh conditions for use of internal combustion engine lubricating oils, as well as effective utilization of resources, waste oil reduction and lubricating oil user cost reduction, the demand for superior long drain properties of lubricating oils continues to increase, and demand is especially high for reducing the low temperature viscosity during engine cold-start and lowering viscous resistance to increase the fuel savings effect. Lubricating base oils used in conventional internal combustion engine lubricating oils, although referred to as "high performance base oils", are not always adequate in terms of their heat and oxidation stability. Also, while it is possible to improve the heat and oxidation stability to some extent by increasing the content of antioxidants, this method has been limited in its improving effect on heat and oxidation stability. Including additives in lubricating base oils can result in some improvement in the viscosity-temperature characteristic/low-temperature viscosity characteristic as well, but this approach has had its own restrictions. Pour point depressants, in particular, do not exhibit effects proportional to the amounts in which they are added, and can even reduce shear stability when added in large amounts.

The properties conventionally evaluated as the low-temperature viscosity characteristic of lubricating base oils and lubricating oils are generally the pour point, clouding point and freezing point. Recently, methods have also been known for evaluating the low-temperature viscosity characteristic based on the lubricating base oils, according to their normal paraffin or isoparaffin contents. Based on investigation by the present inventors, however, in order to realize a lubricating base oil and lubricating oil that can meet the demands mentioned above, it was judged that the indexes of pour point or freezing point are not necessarily suitable as evaluation indexes for the low-temperature viscosity characteristic (fuel economy) of a lubricating base oil.

The present invention has been accomplished in light of these circumstances, and its object is to provide a lubricating oil composition with excellent heat/oxidation stability and viscosity-temperature characteristic/low-temperature viscosity characteristic, that can achieve sufficient long drain properties and fuel savings.

Means for Solving the Problems

In order to solve the problems described above, the invention provides a lubricating oil composition for an internal combustion engine that comprises a lubricating base oil having a urea adduct value of not greater than 4% by mass and a viscosity index of 100 or greater, an ash-free antioxidant containing no sulfur as a constituent element, and at least one compound selected from among ash-free antioxidants containing sulfur as a constituent element and organic molybdenum compounds.

The lubricating base oil in the lubricating oil composition for an internal combustion engine of the invention has a urea adduct value and viscosity index satisfying the conditions specified above, and therefore it itself exhibits excellent heat and oxidation stability. When the lubricating base oil includes additives, it can exhibit a high level of function for the additives while maintaining stable dissolution of the additives. Moreover, by adding both an ash-free antioxidant containing no sulfur as a constituent element (hereinafter also referred to as "component (A)") and at least one compound selected from among ash-free antioxidants containing sulfur as a constituent element and organic molybdenum compounds (hereinafter also referred to as "component (B)") to the lubricating base oil having such excellent properties, it is possible to maximize the effect of improved heat and oxidation stability by synergistic action of components (A) and (B). The lubricating oil composition for an internal combustion engine according to the invention therefore allows a sufficient long drain property to be achieved.

Moreover, since the lubricating base oil in the lubricating oil composition for an internal combustion engine of the invention has a urea adduct value and viscosity index satisfying the respective conditions specified above, it itself exhibits an excellent viscosity-temperature characteristic and frictional properties. Furthermore, the lubricating base oil can reduce viscous resistance or stirring resistance in a practical temperature range due to its excellent viscosity-temperature characteristic, and its effect can be notably exhibited by drastically reducing the viscous resistance or stirring resistance under low temperature conditions of 0° C. and below, thus reducing energy loss in devices and allowing energy savings to be achieved. Moreover, the lubricating base oil is excellent in terms of the solubility and efficacy of its additives, as mentioned above, and therefore a high level of friction reducing effect can be obtained when a friction modifier is added. Consequently, a lubricating oil composition for an internal combustion engine according to the invention containing such an excellent lubricating base oil results in reduced energy loss due to friction resistance or stirring resistance at sliding sections, and can therefore provide adequate energy savings.

It has been difficult to achieve improvement in the low-temperature viscosity characteristic while also ensuring low volatility when using conventional lubricating base oils, but the lubricating base oil of the invention can achieve a satisfactory balance with high levels of both low-temperature viscosity characteristic and low volatility. The lubricating oil composition for an internal combustion engine according to the invention is also useful for improving the cold-start property, in addition to the long drain property and energy savings for internal combustion engines.

The urea adduct value according to the invention is measured by the following method. A 100 g weighed portion of sample oil (lubricating base oil) is placed in a round bottom flask, 200 mg of urea, 360 ml of toluene and 40 ml of methanol are added and the mixture is stirred at room temperature for 6 hours. This produces white particulate crystals as urea adduct in the reaction mixture. The reaction mixture is filtered with a 1 micron filter to obtain the produced white particulate crystals, and the crystals are washed 6 times with 50 ml of toluene. The recovered white crystals are placed in a flask, 300 ml of purified water and 300 ml of toluene are added and the mixture is stirred at 80° C. for 1 hour. The aqueous phase is separated and removed with a separatory funnel, and the toluene phase is washed 3 times with 300 ml of purified water. After dewatering treatment of the toluene phase by addition of a desiccant (sodium sulfate), the toluene is distilled off. The proportion (mass percentage) of urea adduct obtained in this manner with respect to the sample oil is defined as the urea adduct value.

The viscosity index according to the invention, and the kinematic viscosity at 40° C. or kinematic viscosity at 100° C. mentioned hereunder, are the viscosity index and the kinematic viscosity at 40° C. or the kinematic viscosity at 100° C. as measured according to JIS K 2283-1993.

While efforts are being made to improve the isomerization rate from normal paraffins to isoparaffins in conventional refining processes for lubricating base oils by hydrocracking and hydroisomerization, as mentioned above, the present inventors have found that it is difficult to satisfactorily improve the low-temperature viscosity characteristic simply by reducing the residual amount of normal paraffins. That is, although the isoparaffins produced by hydrocracking and hydroisomerization also contain components that adversely affect the low-temperature viscosity characteristic, this fact has not been fully appreciated in the conventional methods of evaluation. Methods such as gas chromatography (GC) and NMR are also applied for analysis of normal paraffins and isoparaffins, but using these analysis methods for separation and identification of the components in isoparaffins that adversely affect the low-temperature viscosity characteristic involves complicated procedures and is time-consuming, making them ineffective for practical use.

With measurement of the urea adduct value according to the invention, on the other hand, it is possible to accomplish precise and reliable collection of components in isoparaffins that can adversely affect the low-temperature viscosity characteristic, as well as normal paraffins when normal paraffins are residually present in the lubricating base oil, as urea adduct, and it is therefore an excellent indicator for evaluation of the low-temperature viscosity characteristic of lubricating base oils. The present inventors have confirmed that when analysis is conducted using GC and NMR, the main urea adducts are urea adducts of normal paraffins and of isoparaffins having 6 or greater carbon atoms from the main chain to the point of branching.

According to the invention, the lubricating base oil is preferably one obtained by a step of hydrocracking/hydroisomerizing a feedstock oil containing normal paraffins so as to obtain a treated product having an urea adduct value of not greater than 4% by mass and a viscosity index of 100 or higher. This can more reliably yield a lubricating oil composition having heat/oxidation stability and high levels of both viscosity-temperature characteristic and low-temperature viscosity characteristic.

In addition, when the lubricating base oil is one obtained by a step of hydrocracking/hydroisomerizing a feedstock oil containing normal paraffins so as to obtain a treated product having an urea adduct value of not greater than 4% by mass and a viscosity index of 100 or higher, the feedstock oil preferably contains at least 50% by mass of a slack wax obtained by solvent dewaxing of a lubricating base oil.

Effect of the Invention

According to the invention, as mentioned above, it is possible to realize a lubricating oil composition for an internal combustion engine that has excellent heat and oxidation stability, as well as an excellent viscosity-temperature characteristic/low-temperature viscosity characteristic, frictional properties and low volatility. Moreover, when the lubricating oil composition for an internal combustion engine according to the invention is applied to an internal combustion engine, it allows a long drain property and energy savings to be achieved, while also improving the cold-start property.

BEST MODE FOR CARRYING OUT THE INVENTION

Preferred embodiments of the invention will now be described in detail.

The lubricating oil composition for an internal combustion engine of the invention comprises a lubricating base oil having a urea adduct value of not greater than 4% by mass and a viscosity index of 100 or greater, (A) an ash-free antioxidant containing no sulfur as a constituent element, and (B) at least one compound selected from among ash-free antioxidants containing sulfur as a constituent element and organic molybdenum compounds.

From the viewpoint of improving the low-temperature viscosity characteristic without impairing the viscosity-temperature characteristic, the urea adduct value of the lubricating base oil of the invention must be not greater than 4 wt % as mentioned above, but it is preferably not greater than 3.5% by mass, more preferably not greater than 3% by mass and even more preferably not greater than 2.5% by mass. The urea adduct value of the lubricating base oil may even be 0% by mass. However, it is preferably 0.1% by mass or greater, more preferably 0.5% by mass or greater and most preferably 0.8% by mass or greater, from the viewpoint of obtaining a lubricating base oil with a sufficient low-temperature viscosity characteristic and a higher viscosity index, and also of relaxing the dewaxing conditions for increased economy.

From the viewpoint of improving the viscosity-temperature characteristic, the viscosity index of the lubricating base oil of the invention must be 100 or higher as mentioned above, but it is preferably 110 or greater, more preferably 120 or greater, even more preferably 130 or greater and most preferably 140 or greater.

The feedstock oil used for producing the lubricating base oil of the invention includes normal paraffins or normal paraffin-containing wax. The feedstock oil may be a mineral oil or a synthetic oil, or a mixture of two or more thereof.

The feedstock oil used for the invention preferably is a wax-containing starting material that boils in the range of lubricating oils according to ASTM D86 or ASTM D2887. The wax content of the feedstock oil is preferably between 50% by mass and 100% by mass based on the total amount of the feedstock oil. The wax content of the starting material can be measured by a method of analysis such as nuclear magnetic resonance spectroscopy (ASTM D5292), correlative ring analysis (n-d-M) (ASTM D3238) or the solvent method (ASTM D3235).

As examples of wax-containing starting materials there may be mentioned oils derived from solvent refining methods such as raffinates, partial solvent dewaxed oils, depitched oils, distillates, reduced pressure gas oils, coker gas oils, slack waxes, foot oil, Fischer-Tropsch waxes and the like, among which slack waxes and Fischer-Tropsch waxes are preferred.

Slack wax is typically derived from hydrocarbon starting materials by solvent or propane dewaxing. Slack waxes may contain residual oil, but the residual oil can be removed by deoiling. Foot oil corresponds to deoiled slack wax.

Fischer-Tropsch waxes are produced by so-called Fischer-Tropsch synthesis.

Commercial normal paraffin-containing feedstock oils are also available. Specifically, there may be mentioned Paraflint 80 (hydrogenated Fischer-Tropsch wax) and Shell MDS Waxy Raffinate (hydrogenated and partially isomerized heart cut distilled synthetic wax raffinate).

Feedstock oil from solvent extraction is obtained by feeding a high boiling point petroleum fraction from atmospheric distillation to a vacuum distillation apparatus and subjecting the distillation fraction to solvent extraction. The residue from vacuum distillation may also be depitched. In solvent extraction methods, the aromatic components are dissolved in the extract phase while leaving more paraffinic components in the raffinate phase. Naphthenes are distributed in the extract phase and raffinate phase. The preferred solvents for solvent extraction are phenols, furfurals and N-methylpyrrolidone. By controlling the solvent/oil ratio, extraction temperature and method of contacting the solvent with the distillate to be extracted, it is possible to control the degree of separation between the extract phase and raffinate phase. There may also be used as the starting material a bottom fraction obtained from a fuel oil hydrocracking apparatus, using a fuel oil hydrocracking apparatus with higher hydrocracking performance.

The lubricating base oil of the invention may be obtained through a step of hydrocracking/hydroisomerizing the feedstock oil so as to obtain a treated product having an urea adduct value of not greater than 4% by mass and a viscosity index of 100 or higher. The hydrocracking/hydroisomerization step is not particularly restricted so long as it satisfies the aforementioned conditions for the urea adduct value and viscosity index of the treated product. A preferred hydrocracking/hydroisomerization step according to the invention comprises a first step in which a normal paraffin-containing feedstock oil is subjected to hydrotreatment using a hydrotreatment catalyst, a second step in which the treated product from the first step is subjected to hydrodewaxing using a hydrodewaxing catalyst, and a third step in which the treated product from the second step is subjected to hydrorefining using a hydrorefining catalyst.

Conventional hydrocracking/hydroisomerization also includes a hydrotreatment step in an early stage of the hydrodewaxing step, for the purpose of desulfurization and denitrogenization to prevent poisoning of the hydrodewaxing catalyst. In contrast, the first step (hydrotreatment step) according to the invention is carried out to decompose a portion (for example, about 10% by mass and preferably 1-10% by mass) of the normal paraffins in the feedstock oil at an early stage of the second step (hydrodewaxing step), thus allowing desulfurization and denitrogenization in the first step as well, although the purpose differs from that of conventional hydrotreatment. The first step is preferred in order to reliably limit the urea adduct value of the treated product obtained after the third step (the lubricating base oil) to not greater than 4% by mass.

As hydrogenation catalysts to be used in the first step there may be mentioned catalysts containing Group 6 metals and Group 8-10 metals, as well as mixtures thereof. As preferred metals there may be mentioned nickel, tungsten, molybdenum and cobalt, and mixtures thereof. The hydrogenation catalyst may be used in a form with the aforementioned metals supported on a heat-resistant metal oxide carrier, and normally the metal will be present on the carrier as an oxide or sulfide. When a mixture of metals is used, it may be used as a bulk metal catalyst with an amount of metal of at least 30% by mass based on the total amount of the catalyst. The metal oxide carrier may be an oxide such as silica, alumina, silica-alumina or titania, with alumina being preferred. Preferred alumina is γ or β porous alumina. The loading amount of the metal is preferably 0.5-35% by mass based on the total amount of the catalyst. When a mixture of a metal of Group 9-10 and a metal of Group 6 is used, preferably the metal of Group 9 or 10 is present in an amount of 0.1-5% by mass and the metal of Group 6 is present in an amount of 5-30% by mass based on the total amount of the catalyst. The loading amount of the metal may be measured by atomic absorption spectrophotometry or inductively coupled plasma emission spectroscopy, or the individual metals may be measured by other ASTM methods.

The acidity of the metal oxide carrier can be controlled by controlling the addition of additives and the property of the metal oxide carrier (for example, controlling the amount of silica incorporated in a silica-alumina carrier). As examples of additives there may be mentioned halogens, especially fluorine, and phosphorus, boron, yttria, alkali metals, alkaline earth metals, rare earth oxides and magnesia. Co-catalysts such as halogens generally raise the acidity of metal oxide carriers, while weakly basic additives such as yttria and magnesia can be used to lower the acidity of the carrier.

As regards the hydrotreatment conditions, the treatment temperature is preferably 150-450° C. and more preferably 200-400° C., the hydrogen partial pressure is preferably 1400-20,000 kPa and more preferably 2800-14,000 kPa, the liquid space velocity (LHSV) is preferably 0.1-10 $hr^{-1}$ and more preferably 0.1-5 $hr^{-1}$, and the hydrogen/oil ratio is preferably 50-1780 $m^3/m^3$ and more preferably 89-890 $m^3/m^3$. These conditions are only for example, and the hydrotreatment conditions in the first step may be appropriately selected for different starting materials, catalysts and apparatuses, in order to obtain the specified urea adduct value and viscosity index for the treated product obtained after the third step.

The treated product obtained by hydrotreatment in the first step may be directly supplied to the second step, but a step of stripping or distillation of the treated product and separating removal of the gas product from the treated product (liquid product) is preferably conducted between the first step and second step. This can reduce the nitrogen and sulfur contents in the treated product to levels that will not affect prolonged use of the hydrodewaxing catalyst in the second step. The main objects of separating removal by stripping and the like are gaseous contaminants such as hydrogen sulfide and ammonia, and stripping can be accomplished by ordinary means such as a flash drum, distiller or the like.

When the hydrotreatment conditions in the first step are mild, residual polycyclic aromatic components can potentially remain depending on the starting material used, and such contaminants may be removed by hydrorefining in the third step.

The hydrodewaxing catalyst used in the second step may contain crystalline or amorphous materials. Examples of crystalline materials include molecular sieves having 10- or 12-membered ring channels, composed mainly of aluminosilicates (zeolite) or silicoaluminophosphates (SAPO). Specific examples of zeolites include ZSM-22, ZSM-23, ZSM-35, ZSM-48, ZSM-57, ferrierite, ITQ-13, MCM-68, MCM-71 and the like. ECR-42 may be mentioned as an example of an aluminophosphate. Examples of molecular sieves include zeolite beta and MCM-68. Among the above there are preferably used one or more selected from among ZSM-48, ZSM-22 and ZSM-23, with ZSM-48 being particularly preferred. The molecular sieves are preferably hydrogen-type. Reduction of the hydrodewaxing catalyst may occur at the time of hydrodewaxing, but alternatively a hydrodewaxing catalyst that has been previously subjected to reduction treatment may be used for the hydrodewaxing.

As amorphous materials for the hydrodewaxing catalyst there may be mentioned alumina doped with Group 3 metals, fluorinated alumina, silica-alumina, fluorinated silica-alumina, silica-alumina and the like.

A preferred mode of the dewaxing catalyst is a bifunctional catalyst, i.e. one carrying a metal hydrogenated component which is at least one metal of Group 6, at least one metal of Groups 8-10 or a mixture thereof. Preferred metals are precious metals of Groups 9-10, such as Pt, Pd or mixtures thereof. Such metals are supported at preferably 0.1-30% by mass based on the total amount of the catalyst. The method for preparation of the catalyst and loading of the metal may be, for example, an ion-exchange method or impregnation method using a decomposable metal salt.

When molecular sieves are used, they may be compounded with a binder material that is heat resistant under the hydrodewaxing conditions, or they may be binderless (self-binding). As binder materials there may be mentioned inorganic oxides, including silica, alumina, silica-alumina, two-component combinations of silica with other metal oxides such as titania, magnesia, yttria and zirconia, and three-component combinations of oxides such as silica-alumina-yttria, silica-alumina-magnesia and the like. The amount of molecular sieves in the hydrodewaxing catalyst is preferably 10-100% by mass and more preferably 35-100% by mass based on the total amount of the catalyst. The hydrodewaxing catalyst may be farmed by a method such as spray-drying or extrusion. The hydrodewaxing catalyst may be used in sulfided or non-sulfided foam, although a sulfided form is preferred.

As regards the hydrodewaxing conditions, the temperature is preferably 250-400° C. and more preferably 275-350° C., the hydrogen partial pressure is preferably 791-20,786 kPa (100-3000 psig) and more preferably 1480-17,339 kPa (200-2500 psig), the liquid space velocity is preferably 0.1-10 $hr^{-1}$ and more preferably 0.1-5 $hr^{-1}$, and the hydrogen/oil ratio is preferably 45-1780 $m^3/m^3$ (250-10,000 scf/B) and more preferably 89-890 $m^3/m^3$ (500-5000 scf/B). These conditions are only for example, and the hydrodewaxing conditions in the second step may be appropriately selected for different starting materials, catalysts and apparatuses, in order to obtain the specified urea adduct value and viscosity index for the treated product obtained after the third step.

The treated product that has been hydrodewaxed in the second step is then supplied to hydrorefining in the third step. Hydrorefining is a form of mild hydrotreatment aimed at removing residual heteroatoms and color phase components while also saturating the olefins and residual aromatic compounds by hydrogenation. The hydrorefining in the third step may be carried out in a cascade fashion with the dewaxing step.

The hydrorefining catalyst used in the third step is preferably one comprising a Group 6 metal, a Group 8-10 metal or a mixture thereof supported on a metal oxide support. As preferred metals there may be mentioned precious metals, and especially platinum, palladium and mixtures thereof. When a mixture of metals is used, it may be used as a bulk metal catalyst with an amount of metal of 30% by mass or greater based on the amount of the catalyst. The metal content of the catalyst is preferably not greater than 20% by mass non-precious metals and preferably not greater than 1% by mass precious metals. The metal oxide support may be either an amorphous or crystalline oxide. Specifically, there may be mentioned low acidic oxides such as silica, alumina, silica-alumina and titania, with alumina being preferred. From the viewpoint of saturation of aromatic compounds, it is preferred to use a hydrorefining catalyst comprising a metal with a relatively powerful hydrogenating function supported on a porous carrier.

As preferred hydrorefining catalysts there may be mentioned meso-microporous materials belonging to the M41S class or line of catalysts. M41S line catalysts are meso-microporous materials with high silica contents, and specific ones include MCM-41, MCM-48 and MCM-50. The hydrorefining catalyst has a pore size of 15-100 Å, and MCM-41 is particularly preferred. MCM-41 is an inorganic porous non-laminar phase with a hexagonal configuration and pores of uniform size. The physical structure of MCM-41 manifests as straw-like bundles with straw openings (pore cell diameters) in the range of 15-100 angstroms. MCM-48 has cubic symmetry, while MCM-50 has a laminar structure. MCM-41 may also have a structure with pore openings having different meso-microporous ranges according to methods for producing thereof. The meso-microporous material may contain metal hydrogenated components, the metal consisting of one or more Group 8, 9 or 10 metals, and preferred as metal hydrogenated components are precious metals, especially Group 10 precious metals, and most preferably Pt, Pd or their mixtures.

As regards the hydrorefining conditions, the temperature is preferably 150-350° C. and more preferably 180-250° C., the total pressure is preferably 2859-20,786 kPa (approximately 400-3000 psig), the liquid space velocity is preferably 0.1-5 $hr^{-1}$ and more preferably 0.5-3 $hr^{-1}$, and the hydrogen/oil ratio is preferably 44.5-1780 $m^3/m^3$ (250-10,000 scf/B). These conditions are only for example, and the hydrorefining conditions in the third step may be appropriately selected for different starting materials and treatment apparatuses, so that the urea adduct value and viscosity index for the treated product obtained after the third step satisfy the respective conditions specified above.

The treated product obtained after the third step may be subjected to distillation or the like as necessary for separating removal of certain components.

The lubricating base oil of the invention obtained by the production process described above is not restricted in terms of its other properties so long as the urea adduct value and viscosity index satisfy their respective conditions, but the lubricating base oil of the invention preferably also satisfies the conditions specified below.

The saturated components content of the lubricating base oil of the invention is preferably 90% by mass or greater, more preferably 93% by mass or greater and even more preferably 95% by mass or greater based on the total amount of the lubricating base oil. The proportion of cyclic saturated components among the saturated components is preferably 0.1-50% by mass, more preferably 0.5-40% by mass, even more preferably 1-30% by mass and most preferably 5-20% by mass. If the saturated components content and proportion of cyclic saturated components among the saturated components both satisfy these respective conditions, it will be possible to achieve adequate levels for the viscosity-temperature characteristic and heat and oxidation stability, while additives added to the lubricating base oil will be kept in a sufficiently stable dissolved state in the lubricating base oil, and it will be possible for the functions of the additives to be exhibited at a higher level. In addition, a saturated components content and proportion of cyclic saturated components among the saturated components satisfying the aforementioned conditions can improve the frictional properties of the lubricating base oil itself, resulting in a greater friction reducing effect and thus increased energy savings.

If the saturated component content is less than 90% by mass, the viscosity-temperature characteristic, heat and oxidation stability and frictional properties will tend to be inadequate. If the proportion of cyclic saturated components among the saturated components is less than 0.1% by mass, the solubility of the additives included in the lubricating base oil will be insufficient and the effective amount of additives kept dissolved in the lubricating base oil will be reduced, making it impossible to effectively achieve the function of the additives. If the proportion of cyclic saturated components among the saturated components is greater than 50% by mass, the efficacy of additives included in the lubricating base oil will tend to be reduced.

According to the invention, a proportion of 0.1-50% by mass cyclic saturated components among the saturated components is equivalent to 99.9-50% by mass acyclic saturated components among the saturated components. Both normal paraffins and isoparaffins are included by the term "acyclic saturated components". The proportions of normal paraffins and isoparaffins in the lubricating base oil of the invention are not particularly restricted so long as the urea adduct value satisfies the condition specified above, but the proportion of isoparaffins is preferably 50-99.9% by mass, more preferably 60-99.9% by mass, even more preferably 70-99.9% by mass and most preferably 80-99.9% by mass based on the total amount of the lubricating base oil. If the proportion of isoparaffins in the lubricating base oil satisfies the aforementioned conditions it will be possible to further improve the viscosity-temperature characteristic and heat and oxidation stability, while additives added to the lubricating base oil will be kept in a sufficiently stable dissolved state in the lubricating base oil and it will be possible for the functions of the additives to be exhibited at an even higher level.

The saturated component content for the purpose of the invention is the value measured according to ASTM D 2007-93 (units: % by mass).

The proportions of the cyclic saturated components and acyclic saturated components among the saturated components for the purpose of the invention are the naphthene portion (measurement of monocyclic-hexacyclic naphthenes, units: % by mass) and alkane portion (units: % by mass), respectively, both measured according to ASTM D 2786-91.

The proportion of normal paraffins in the lubricating base oil for the purpose of the invention is the value obtained by analyzing saturated components separated and fractionated by the method of ASTM D 2007-93 by gas chromatography under the following conditions, and calculating the value obtained by identifying and quantifying the proportion of normal paraffins among those saturated components, with respect to the total amount of the lubricating base oil. For identification and quantitation, a C5-C50 straight-chain normal paraffin mixture sample is used as the reference sample, and the normal paraffin content among the saturated components is determined as the proportion of the total of the peak areas corresponding to each normal paraffin, with respect to the total peak area of the chromatogram (subtracting the peak area for the diluent).

(Gas Chromatography Conditions)

Column: Liquid phase nonpolar column (length: 25 mm, inner
diameter: 0.3 mmϕ, liquid phase film thickness: 0.1 μm), temperature
elevating conditions: 50° C.-400° C. (temperature-elevating rate: 10° C./min).

Carrier gas: helium (linear speed: 40 cm/min)

Split ratio: 90/1

Sample injection rate: 0.5 μL (injection rate of sample diluted 20-fold with carbon disulfide).

The proportion of isoparaffins in the lubricating base oil is the value of the difference between the acyclic saturated components among the saturated components and the normal paraffins among the saturated components, based on the total amount of the lubricating base oil.

Other methods may be used for separation of the saturated components or for compositional analysis of the cyclic saturated components and acyclic saturated components, so long as they provide similar results. Examples of other methods include the method according to ASTM D 2425-93, the method according to ASTM D 2549-91, methods of high performance liquid chromatography (HPLC), and modified forms of these methods.

When the bottom fraction obtained from a fuel oil hydrocracker is used as the starting material for the lubricating base oil of the invention, the obtained base oil will have a saturated components content of 90% by mass or greater, a proportion of cyclic saturated components in the saturated components of 30-50% by mass, a proportion of acyclic saturated components in the saturated components of 50-70% by mass, a proportion of isoparaffins in the lubricating base oil of 40-70% by mass and a viscosity index of 100-135 and preferably 120-130, but if the urea adduct value satisfies the conditions specified above it will be possible to obtain a lubricating oil composition with the effect of the invention, i.e. an excellent low-temperature viscosity characteristic wherein the MRV viscosity at −40° C. is not greater than 20,000 mPa·s and especially not greater than 10,000 mPa·s.

When a slack wax or Fischer-Tropsch wax having a high wax content (for example, a normal paraffin content of 50% by mass or greater) is used as the starting material for the lubricating base oil of the invention, the obtained base oil will have a saturated components content of 90% by mass or greater, a proportion of cyclic saturated components in the saturated components of 0.1-40% by mass, a proportion of acyclic saturated components in the saturated components of 60-99.9% by mass, a proportion of isoparaffins in the lubricating base oil of 60-99.9% by mass and a viscosity index of 100-170 and preferably 135-160, but if the urea adduct value satisfies the conditions specified above it will be possible to obtain a lubricating oil composition with very excellent properties in terms of the effect of the invention, and especially the high viscosity index and low-temperature viscosity characteristic, wherein the MRV viscosity at −40° C. is not greater than 12,000 mPa·s and especially not greater than 7000 mPa·s.

The aromatic components content of the lubricating base oil of the invention is preferably not greater than 5% by mass, more preferably 0.05-3% by mass, even more preferably 0.1-1% by mass and most preferably 0.1-0.5% by mass based on the total amount of the lubricating base oil. If the aromatic components content exceeds the aforementioned upper limit, the viscosity-temperature characteristic, heat and oxidation stability, frictional properties, low volatility and low-temperature viscosity characteristic will tend to be reduced, while the efficacy of additives when added to the lubricating base oil will also tend to be reduced. The lubricating base oil of the invention may be free of aromatic components, but the solubility of additives can be further increased with an aromatic components content of 0.05% by mass or greater.

The aromatic components content in this case is the value measured according to ASTM D 2007-93. The aromatic portion normally includes alkylbenzenes and alkylnaphthalenes, as well as anthracene, phenanthrene and their alkylated forms, compounds with four or more fused benzene rings, and heteroatom-containing aromatic compounds such as pyridines, quinolines, phenols, naphthols and the like.

The % $C_p$ value of the lubricating base oil of the invention is preferably 80 or greater, more preferably 82-99, even more preferably 85-98 and most preferably 90-97. If the % $C_p$ value of the lubricating base oil is less than 80, the viscosity-temperature characteristic, heat and oxidation stability and frictional properties will tend to be reduced, while the efficacy of additives when added to the lubricating base oil will also tend to be reduced. If the % $C_p$ value of the lubricating base oil is greater than 99, on the other hand, the additive solubility will tend to be lower.

The % $C_N$ value of the lubricating base oil of the invention is preferably not greater than 20, more preferably not greater than 15, even more preferably 1-12 and yet more preferably 3-10. If the % $C_N$ value of the lubricating base oil exceeds 20, the viscosity-temperature characteristic, heat and oxidation stability and frictional properties will tend to be reduced. If the % $C_N$ is less than 1, however, the additive solubility will tend to be lower.

The % $C_A$ value of the lubricating base oil is preferably not greater than 0.7, more preferably not greater than 0.6 and even more preferably 0.1-0.5. If the % $C_A$ value of the lubricating base oil exceeds 0.7, the viscosity-temperature characteristic, heat and oxidation stability and frictional properties will tend to be reduced. The % $C_A$ value of the lubricating base oil of the invention may be zero, but the solubility of additives can be further increased with a % $C_A$ value of 0.1 or greater.

The ratio of the % $C_P$ and % $C_N$ values for the lubricating base oil of the invention is % $C_P$/% $C_N$ of preferably 7 or greater, more preferably 7.5 or greater and even more preferably 8 or greater. If the % $C_P$/% $C_N$ ratio is less than 7, the viscosity-temperature characteristic, heat and oxidation stability and frictional properties will tend to be reduced, while the efficacy of additives when added to the lubricating base oil will also tend to be reduced. The % $C_P$/% $C_N$ ratio is preferably not greater than 200, more preferably not greater than 100, even more preferably not greater than 50 and most preferably not greater than 25. The additive solubility can be further increased if the % $C_P$/% $C_N$ ratio is not greater than 200.

The % $C_P$, % $C_N$ and % $C_A$ values for the purpose of the invention are, respectively, the percentage of paraffinic carbons with respect to total carbons, the percentage of naphthenic carbons with respect to total carbons and the percentage of aromatic carbons with respect to total carbons, as determined by the method of ASTM D 3238-85 (n-d-M ring analysis). That is, the preferred ranges for % $C_P$, % $C_N$ and % $C_A$ are based on values determined by these methods, and for example, % $C_N$ may be a value exceeding 0 according to these methods even if the lubricating base oil contains no naphthene portion.

The iodine value of the lubricating base oil of the invention is preferably not greater than 0.5, more preferably not greater than 0.3 and even more preferably not greater than 0.15, and although it may be less than 0.01, it is preferably 0.001 or greater and more preferably 0.05 or greater in consideration of economy and achieving a significant effect. Limiting the iodine value of the lubricating base oil to not greater than 0.5 can drastically improve the heat and oxidation stability. The "iodine value" for the purpose of the invention is the iodine value measured by the indicator titration method according to JIS K 0070, "Acid numbers, Saponification Values, Iodine Values, Hydroxyl Values And Unsaponification Values Of Chemical Products".

The sulfur content in the lubricating base oil of the invention will depend on the sulfur content of the starting material. For example, when using a substantially sulfur-free starting material as for synthetic wax components obtained by Fischer-Tropsch reaction, it is possible to obtain a substantially sulfur-free lubricating base oil. When using a sulfur-containing starting material, such as slack wax obtained by a lubricating base oil refining process or microwax obtained by a wax refining process, the sulfur content of the obtained lubricating base oil will normally be 100 ppm by mass or greater. From the viewpoint of further improving the heat and oxidation stability and reducing sulfur, the sulfur content in the lubricating base oil of the invention is preferably not greater than 10 ppm by mass, more preferably not greater than 5 ppm by mass and even more preferably not greater than 3 ppm by mass.

From the viewpoint of cost reduction it is preferred to use slack wax or the like as the starting material, in which case the sulfur content of the obtained lubricating base oil is preferably not greater than 50 ppm by mass and more preferably not greater than 10 ppm by mass. The sulfur content for the purpose of the invention is the sulfur content measured according to JIS K 2541-1996.

The nitrogen content in the lubricating base oil of the invention is not particularly restricted, but is preferably not greater than 5 ppm by mass, more preferably not greater than 3 ppm by mass and even more preferably not greater than 1 ppm by mass. If the nitrogen content exceeds 5 ppm by mass, the heat and oxidation stability will tend to be reduced. The nitrogen content for the purpose of the invention is the nitrogen content measured according to JIS K 2609-1990.

The kinematic viscosity of the lubricating base oil according to the invention, as the kinematic viscosity at 100° C., is preferably 1.5-20 $mm^2/s$ and more preferably 2.0-11 $mm^2/s$. A kinematic viscosity at 100° C. of lower than 1.5 $mm^2/s$ for the lubricating base oil is not preferred from the standpoint of evaporation loss. If it is attempted to obtain a lubricating base oil having a kinematic viscosity at 100° C. of greater than 20 $mm^2/s$, the yield will be reduced and it will be difficult to increase the cracking severity even when using a heavy wax as the starting material.

According to the invention, lubricating base oils having a kinematic viscosity at 100° C. in the following ranges are preferably used after fractionation by distillation or the like.

(I) A lubricating base oil with a kinematic viscosity at 100° C. of at least 1.5 $mm^2/s$ and less than 3.5 $mm^2/s$, and more preferably 2.0-3.0 $mm^2/s$.

(II) A lubricating base oil with a kinematic viscosity at 100° C. of at least 3.0 $mm^2/s$ and less than 4.5 $mm^2/s$, and more preferably 3.5-4.1 $mm^2/s$.

(III) A lubricating base oil with a kinematic viscosity at 100° C. of 4.5-20 $mm^2/s$, more preferably 4.8-11 $mm^2/s$ and most preferably 5.5-8.0 $mm^2/s$.

The kinematic viscosity at 40° C. of the lubricating base oil of the invention is preferably 6.0-80 $mm^2/s$ and more preferably 8.0-50 $mm^2/s$. According to the invention, a lube-oil distillate having a kinematic viscosity at 40° C. in one of the following ranges is preferably used after fractionation by distillation or the like.

(IV) A lubricating base oil with a kinematic viscosity at 40° C. of at least 6.0 $mm^2/s$ and less than 12 $mm^2/s$, and more preferably 8.0-12 $mm^2/s$.

(V) A lubricating base oil with a kinematic viscosity at 40° C. of at least 12 $mm^2/s$ and less than 28 $mm^2/s$, and more preferably 13-19 $mm^2/s$.

(VI) A lubricating base oil with a kinematic viscosity at 40° C. of 28-50 $mm^2/s$, more preferably 29-45 $mm^2/s$ and most preferably 30-40 $mm^2/s$.

The lubricating base oils (I) and (IV), having a urea adduct value and viscosity index satisfying the respective conditions specified above, can achieve high levels of both viscosity-temperature characteristic and low-temperature viscosity characteristic compared to conventional lubricating base oils of the same viscosity grade, and in particular they have an excellent low-temperature viscosity characteristic, and the viscous resistance or stirring resistance can notably reduced. Moreover, by including a pour point depressant it is possible to lower the BF viscosity at −40° C. to below 2000 mPa·s. The BF viscosity at −40° C. is the viscosity measured according to JPI-5S-26-99.

The lubricating base oils (II) and (V) having urea adduct values and viscosity indexes satisfying the respective conditions specified above can achieve high levels of both the viscosity-temperature characteristic and low-temperature viscosity characteristic compared to conventional lubricating base oils of the same viscosity grade, and in particular they have an excellent low-temperature viscosity characteristic, and superior lubricity and low volatility. For example, with lubricating base oils (II) and (V) it is possible to lower the CCS viscosity at −35° C. to below 3000 mPa·s.

The lubricating base oils (III) and (VI), having urea adduct values and viscosity indexes satisfying the respective conditions specified above, can achieve high levels of both the viscosity-temperature characteristic and low-temperature viscosity characteristic compared to conventional lubricating base oils of the same viscosity grade, and in particular they have an excellent low-temperature viscosity characteristic, and superior heat and oxidation stability, lubricity and low volatility.

The refractive index at 20° C. of the lubricating base oil of the invention will depend on the viscosity grade of the lubricating base oil, but the refractive indexes at 20° C. of the lubricating base oils (I) and (IV) mentioned above are preferably not greater than 1.455, more preferably not greater than 1.453 and even more preferably not greater than 1.451. The refractive index at 20° C. of the lubricating base oils (II) and (V) is preferably not greater than 1.460, more preferably not greater than 1.457 and even more preferably not greater than 1.455. The refractive index at 20° C. of the lubricating base oils (III) and (VI) is preferably not greater than 1.465, more preferably not greater than 1.463 and even more preferably not greater than 1.460. If the refractive index exceeds the aforementioned upper limit, the viscosity-temperature characteristic, heat and oxidation stability, low volatility and low-temperature viscosity characteristic of the lubricating base oil will tend to be reduced, while the efficacy of additives when added to the lubricating base oil will also tend to be reduced.

The pour point of the lubricating base oil of the invention will depend on the viscosity grade of the lubricating base oil, and for example, the pour point for the lubricating base oils (I) and (IV) is preferably not higher than −10° C., more preferably not higher than −12.5° C. and even more preferably not higher than −15° C. The pour point for the lubricating base oils (II) and (V) is preferably not higher than −10° C., more preferably not higher than −15° C. and even more preferably not higher than −17.5° C. The pour point for the lubricating base oils (III) and (VI) is preferably not higher than −10° C., more preferably not higher than −12.5° C. and even more preferably not higher than −15° C. If the pour point exceeds the upper limit specified above, the low-temperature flow properties of lubricating oils employing the lubricating base oils will tend to be reduced. The pour point for the purpose of the invention is the pour point measured according to JIS K 2269-1987.

The CCS viscosity at −35° C. of the lubricating base oil of the invention will depend on the viscosity grade of the lubricating base oil, but the CCS viscosities at −35° C. of the lubricating base oils (I) and (IV) are preferably not greater than 1000 mPa·s. The CCS viscosities at −35° C. of the lubricating base oils (II) and (V) are preferably not greater than 3000 mPa·s, more preferably not greater than 2400 mPa·s, even more preferably not greater than 2000 mPa·s, yet more preferably not greater than 1800 mPa·s and most preferably not greater than 1600 mPa·s. The CCS viscosities at −35° C. of the lubricating base oils (III) and (VI) are preferably not greater than 15,000 mPa·s and more preferably not greater than 10,000 mPa·s. If the CCS viscosity at −35° C. exceeds the upper limit specified above, the low-temperature flow properties of lubricating oils employing the lubricating base oils will tend to be reduced. The CCS viscosity at −35° C. for the purpose of the invention is the viscosity measured according to JIS K 2010-1993.

The BF viscosity at −40° C. of the lubricating base oil of the invention will depend on the viscosity grade of the lubricating base oil, but the BF viscosities at −40° C. of the lubricating base oils (I) and (IV), for example, are preferably not greater than 10,000 mPa·s, more preferably 8000 mPa·s, and even more preferably not greater than 6000 mPa·s. The BF viscosities at −40° C. of the lubricating base oils (II) and (V) are preferably not greater than 1,500,000 mPa·s and more preferably not greater than 1,000,000 mPa·s. If the BF viscosity at −40° C. exceeds the upper limit specified above, the low-temperature flow properties of lubricating oils employing the lubricating base oils will tend to be reduced.

The density ($\rho_{15}$) at 15° C. of the lubricating base oil of the invention will also depend on the viscosity grade of the lubricating base oil, but it is preferably not greater than the value of $\rho$ represented by the following formula (1), i.e., $\rho_{15} \leq \rho$.

$$\rho = 0.0025 \times kv100 + 0.816 \quad (1)$$

[In this equation, kv100 represents the kinematic viscosity at 100° C. ($mm^2/s$) of the lubricating base oil.]

If $\rho_{15} > \rho$, the viscosity-temperature characteristic, heat and oxidation stability, low volatility and low-temperature viscosity characteristic of the lubricating base oil will tend to be reduced, while the efficacy of additives when added to the lubricating base oil will also tend to be reduced.

The value of $\rho_{15}$ for lubricating base oils (I) and (IV), for example, is preferably not greater than 0.825 and more preferably not greater than 0.820. The value of $\rho_{15}$ for lubricating base oils (II) and (V) is preferably not greater than 0.835 and more preferably not greater than 0.830. Also, the value of $\rho_{15}$ for lubricating base oils (III) and (VI) is preferably not greater than 0.840 and more preferably not greater than 0.835.

The density at 15° C. for the purpose of the invention is the density measured at 15° C. according to JIS K 2249-1995.

The aniline point (AP (° C.)) of the lubricating base oil of the invention will also depend on the viscosity grade of the lubricating base oil, but it is preferably greater than or equal to the value of A as represented by the following formula (2), i.e., $AP \geq A$.

$$A = 4.3 \times kv100 + 100 \quad (2)$$

[In this equation, kv100 represents the kinematic viscosity at 100° C. ($mm^2/s$) of the lubricating base oil.]

If $AP < A$, the viscosity-temperature characteristic, heat and oxidation stability, low volatility and low-temperature viscosity characteristic of the lubricating base oil will tend to be reduced, while the efficacy of additives when added to the lubricating base oil will also tend to be reduced.

The AP for the lubricating base oils (I) and (IV) is preferably 108° C. or higher and more preferably 110° C. or higher. The AP for the lubricating base oils (II) and (V) is preferably 113° C. or higher and more preferably 119° C. or higher. Also, the AP for the lubricating base oils (III) and (VI) is preferably 125° C. or higher and more preferably 128° C. or higher. The aniline point for the purpose of the invention is the aniline point measured according to JIS K 2256-1985.

The NOACK evaporation loss of the lubricating base oil of the invention is not particularly restricted, and for example, the NOACK evaporation loss for lubricating base oils (I) and (IV) it is preferably 20% by mass or greater, more preferably 25% by mass or greater and even more preferably 30 or greater, and preferably not greater than 50% by mass, more preferably not greater than 45% by mass and even more preferably not greater than 40% by mass. The NOACK evaporation loss for lubricating base oils (II) and (V) is preferably 5% by mass or greater, more preferably 8% by mass or greater and even more preferably 10% by mass or greater, and preferably not greater than 20% by mass, more preferably not greater than 16% by mass and even more preferably not greater than 15% by mass. The NOACK evaporation loss for lubricating base oils (III) and (VI) is preferably 0% by mass or greater and more preferably 1% by mass or greater, and preferably not greater than 6% by mass, more preferably not greater than 5% by mass and even more preferably not greater than 4% by mass. If the NOACK evaporation loss is below the aforementioned lower limit it will tend to be difficult to improve the low-temperature viscosity characteristic. If the NOACK evaporation loss is above the respective upper limit, the evaporation loss of the lubricating oil will be increased when the lubricating base oil is used as a lubricating oil for an internal combustion engine, and catalyst poisoning will be undesirably accelerated as a result. The NOACK evaporation loss for the purpose of the invention is the evaporation loss as measured according to ASTM D 5800-95.

The distillation properties of the lubricating base oil of the invention are preferably an initial boiling point (IBP) of 290-440° C. and a final boiling point (FBP) of 430-580° C. in gas chromatography distillation, and rectification of one or more fractions selected from among fractions in this distillation range can yield lubricating base oils (I)-(III) and (IV)-(VI) having the aforementioned preferred viscosity ranges.

For the distillation properties of the lubricating base oils (I) and (IV), for example, the initial boiling point (IBP) is preferably 260-340° C., more preferably 270-330° C. and even more preferably 280-320° C. The 10% distillation temperature (T10) is preferably 310-390° C., more preferably 320-380° C. and even more preferably 330-370° C. The 50% running point (T50) is preferably 340-440° C., more preferably 360-430° C. and even more preferably 370-420° C. The 90% running point (T90) is preferably 405-465° C., more preferably 415-455° C. and even more preferably 425-445° C. The final boiling point (FBP) is preferably 430-490° C., more preferably 440-480° C. and even more preferably 450-490° C. T90-T10 is preferably 60-140° C., more preferably 70-130° C. and even more preferably 80-120° C. FBP-IBP is preferably 140-200° C., more preferably 150-190° C. and even more preferably 160-180° C. T10-IBP is preferably 40-100° C., more preferably 50-90° C. and even more preferably 60-80° C. FBP-T90 is preferably 5-60° C., more preferably 10-55° C. and even more preferably 15-50° C.

For the distillation properties of the lubricating base oils (II) and (V), the initial boiling point (IBP) is preferably 310-400° C., more preferably 320-390° C. and even more preferably 330-380° C. The 10% distillation temperature (T10) is preferably 350-430° C., more preferably 360-420° C. and even more preferably 370-410° C. The 50% running point (T50) is preferably 390-470° C., more preferably 400-460° C. and even more preferably 410-450° C. The 90% running point (T90) is preferably 420-490° C., more preferably 430-480° C. and even more preferably 440-470° C. The final boiling point (FBP) is preferably 450-530° C., more preferably 460-520° C. and even more preferably 470-510° C. T90-T10 is preferably 40-100° C., more preferably 45-90° C. and even more preferably 50-80° C. FBP-IBP is preferably 110-170° C., more preferably 120-160° C. and even more preferably 130-150° C. T10-IBP is preferably 5-60° C., more preferably 10-55° C. and even more preferably 15-50° C. FBP-T90 is preferably 5-60° C., more preferably 10-55° C. and even more preferably 15-50° C.

For the distillation properties of the lubricating base oils (III) and (VI), the initial boiling point (IBP) is preferably 440-480° C., more preferably 430-470° C. and even more preferably 420-460° C. The 10% distillation temperature (T10) is preferably 450-510° C., more preferably 460-500° C. and even more preferably 460-480° C. The 50% running point (T50) is preferably 470-540° C., more preferably 480-530° C. and even more preferably 490-520° C. The 90% running point (T90) is preferably 470-560° C., more preferably 480-550° C. and even more preferably 490-540° C. The final boiling point (FBP) is preferably 505-565° C., more preferably 515-555° C. and even more preferably 525-565° C. T90-T10 is preferably 35-80° C., more preferably 45-70° C. and even more preferably 55-80° C. FBP-IBP is preferably 50-130° C., more preferably 60-120° C. and even more preferably 70-110° C.

T10-IBP is preferably 5-65° C., more preferably 10-55° C. and even more preferably 10-45° C. FBP-T90 is preferably 5-60° C., more preferably 5-50° C. and even more preferably 5-40° C.

By setting IBP, T10, T50, T90, FBP, T90-T10, FBP-IBP, T10-IBP and FBP-T90 within the preferred ranges specified above for lubricating base oils (I)-(VI), it is possible to further improve the low temperature viscosity and further reduce the evaporation loss. If the distillation ranges for T90-T10, FBP-IBP, T10-IBP and FBP-T90 are too narrow, the lubricating base oil yield will be poor resulting in low economy.

The IBP, T10, T50, T90 and FBP values for the purpose of the invention are the running points measured according to ASTM D 2887-97.

The residual metal content in the lubricating base oil of the invention derives from metals in the catalyst or starting materials that have become unavoidable contaminants during the production process, and it is preferred to thoroughly remove such residual metal contents. For example, the Al, Mo and Ni contents are each preferably not greater than 1 ppm by mass. If the metal contents exceed the aforementioned upper limit, the functions of additives in the lubricating base oil will tend to be inhibited.

The residual metal content for the purpose of the invention is the metal content as measured according to JPI-5S-38-2003.

The lubricating base oil of the invention preferably exhibits a RBOT life as specified below, correlating with its kinematic viscosity. For example, the RBOT life for the lubricating base oils (I) and (IV) is preferably 290 min or longer, more preferably 300 min or longer and even more preferably 310 min or longer. Also, the RBOT life for the lubricating base oils (II) and (V) is preferably 375 min or longer, more preferably 400 min or longer and even more preferably 425 min or longer. The RBOT life for the lubricating base oils (III) and (VI) is preferably 400 min or longer, more preferably 425 min or longer and even more preferably 440 min or longer. If the RBOT life of the lubricating base oil is less than the specified lower limit, the viscosity-temperature characteristic and heat and oxidation stability of the lubricating base oil will tend to be reduced, while the efficacy of additives when added to the lubricating base oil will also tend to be reduced.

The RBOT life for the purpose of the invention is the RBOT value as measured according to JIS K 2514-1996, for a composition obtained by adding a phenol-based antioxidant (2,6-di-tert-butyl-p-cresol: DBPC) at 0.2% by mass to the lubricating base oil.

The lubricating base oil of the invention having the composition described above exhibits an excellent viscosity-temperature characteristic and low-temperature viscosity characteristic, while also having low viscous resistance and stirring resistance and improved heat and oxidation stability and frictional properties, making it possible to achieve an increased friction reducing effect and thus improved energy savings. When additives are included in the lubricating base oil of the invention, the functions of the additives (improved low-temperature viscosity characteristic with pour point depressants, improved heat and oxidation stability by antioxidants, increased friction reducing effect by friction modifiers, improved wear resistance by anti-wear agents, etc.) are exhibited at a higher level. The invention is an internal combustion engine lubricating oil for an internal combustion engine such as a passenger vehicle gasoline engine, two-wheel vehicle gasoline engine, diesel engine, gas engine, gas heat pump engine, marine engine, electric power engine or the like, but the lubricating base oil of the invention may also be applied as a lubricating oil for a drive transmission such as an automatic transmission, manual transmission, non-stage transmission, final reduction gear or the like (drive transmission oil), as a hydraulic oil for a hydraulic power unit such as a damper, construction machine or the like, or as a compressor oil, turbine oil, industrial gear oil, refrigerator oil, rust preventing oil, heating medium oil, gas holder seal oil, bearing oil, paper machine oil, machine tool oil, sliding guide surface oil, electrical insulating oil, cutting oil, press oil, rolling oil, heat treatment oil or the like, and using the lubricating base oil of the invention for these purposes will allow the improved characteristics of the lubricating oil including the viscosity-temperature characteristic, heat and oxidation stability, energy savings and fuel efficiency to be exhibited at a high level, together with a longer lubricating oil life and lower levels of environmentally unfriendly substances.

The lubricating oil composition of the invention may be used alone as a lubricating base oil according to the invention, or the lubricating base oil of the invention may be combined with one or more other base oils. When the lubricating base oil of the invention is combined with another base oil, the proportion of the lubricating base oil of the invention of the total mixed base oil is preferably at least 30% by mass, more preferably at least 50% by mass and even more preferably at least 70% by mass.

There are no particular restrictions on the other base oil used in combination with the lubricating base oil of the invention, and examples of mineral oil base oils include solvent refined mineral oils, hydrocracked mineral oil, hydrorefined mineral oils and solvent dewaxed base oils having kinematic viscosities at 100° C. of 1-100 $mm^2/s$.

As synthetic base oils there may be mentioned poly-α-olefins and their hydrogenated forms, isobutene oligomers and their hydrogenated forms, isoparaffins, alkylbenzenes, alkylnaphthalenes, diesters (ditridecyl glutarate, di-2-ethylhexyl adipate, diisodecyl adipate, ditridecyl adipate, di-2-ethylhexyl sebacate and the like), polyol esters (trimethylolpropane caprylate, trimethylolpropane pelargonate, pentaerythritol 2-ethylhexanoate, pentaerythritol pelargonate and the like), polyoxyalkylene glycols, dialkyldiphenyl ethers and polyphenyl ethers, among which poly-α-olefins are preferred. As typical poly-α-olefins there may be mentioned C2-C32 and preferably C6-C16 α-olefin oligomers or co-oligomers (1-octene oligomer, decene oligomer, ethylene-propylene co-oligomers and the like), and their hydrides.

There are no particular restrictions on the process for producing poly-α-olefins, and an example is a process wherein an α-olefin is polymerized in the presence of a polymerization catalyst such as a Friedel-Crafts catalyst comprising a complex of aluminum trichloride or boron trifluoride with water, an alcohol (ethanol, propanol, butanol or the like) and a carboxylic acid or ester.

The lubricating oil composition for an internal combustion engine according to the invention comprises, as component (A), an ash-free antioxidant containing no sulfur as a constituent element. Component (A) is preferably a phenol-based or amine-based ash-free antioxidant containing no sulfur as a constituent element.

Specific examples of phenol-based ash-free antioxidants containing no sulfur as a constituent element include 4,4'-methylenebis(2,6-di-tert-butylphenol), 4,4'-bis(2,6-di-tert-butylphenol), 4,4'-bis(2-methyl-6-tert-butylphenol), 2,2'-methylenebis(4-ethyl-6-tert-butylphenol), 2,2'-methylenebis(4-methyl-6-tert-butylphenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 2,6-di-tert-butyl-4-methylphenol, 2,6-di-tert-butyl-4-ethylphenol, 2,4-dimethyl-6-tert-butylphenol, 2,6-di-tert-α-dimethylamino-p-cresol, 2,6-di-tert-butyl-4 (N,N'-dimethylaminomethylphenol), octyl-3-(3,5-di-tert-butyl-4-hydroxyphenyl)propionate, tridecyl-3-(3,5-di-tert-butyl-4-hydroxyphenyl)propionate, pentaerythrityl-tetrakis[3-(3,5-di-tert-butyl-4-hydroxyphenyl)propionate], octadecyl-3-(3,5-di-tert-butyl-4-hydroxyphenyl)propionate, octyl-3-(3,5-di-tert-butyl-4-hydroxyphenyl)propionate and octyl-3-(3-methyl-5-tert-butyl-4-hydroxyphenyl)propionate. Among these there are preferred hydroxyphenyl group-substituted esteric antioxidants that are esters of hydroxyphenyl group-substituted fatty acids and C4-12 alcohols ((octyl-3-(3,5-di-tert-butyl-4-hydroxyphenyl)propionate, octyl-3-(3-methyl-5-tert-butyl-4-hydroxyphenyl)propionate and the like) and bisphenol-based antioxidants, with hydroxyphenyl group-substituted esteric antioxidants being more preferred. Phenol-based compounds with a molecular weight of 240 or greater are preferred for their high decomposition temperatures which allow them to exhibit their effects even under high-temperature conditions.

As specific amine-based ash-free antioxidants containing no sulfur as a constituent element there may be mentioned phenyl-α-naphthylamine, alkylphenyl-α-naphthylamines, alkyldiphenylamines, dialkyldiphenylamines, N,N'-diphenyl-p-phenylenediamine, and mixtures of the foregoing. The alkyl groups in these amine-based ash-free antioxidants are preferably C1-C20 straight-chain or branched alkyl groups, and more preferably C4-C12 straight-chain or branched alkyl groups.

There are no particular restrictions on the content of component (A) according to the invention, but it is preferably 0.01% by mass or greater, more preferably 0.1% by mass or greater, even more preferably 0.5% by mass or greater and most preferably 1.0% by mass or greater, and preferably not greater than 5% by mass, more preferably not greater than 3% by mass and most preferably not greater than 2% by mass, based on the total amount of the composition. If the content is less than 0.01% by mass the heat and oxidation stability of the lubricating oil composition will be insufficient, and it may not be possible to maintain superior cleanability for prolonged periods. On the other hand, a content of component (A) exceeding 5% by mass will tend to reduce the storage stability of the lubricating oil composition.

According to the invention, a combination of 0.4-2% by mass of a phenol-based ash-free antioxidant and 0.4-2% by mass of an amine-based ash-free antioxidant, based on the total amount of the composition, may be used in combination as component (A), or most preferably, an amine-based antioxidant may be used alone at 0.5-2% by mass and more preferably 0.6-1.5% by mass, which will allow excellent cleanability to be maintained for long periods.

The lubricating oil composition for an internal combustion engine according to the invention comprises, as component (B): (B-1) an ash-free antioxidant containing sulfur as a constituent element and (B-2) an organic molybdenum compound.

As (B-1) the ash-free antioxidant containing sulfur as a constituent element, there may be suitably used sulfurized fats and oils, dihydrocarbyl polysulfide, dithiocarbamates, thiadiazoles and phenol-based ash-free antioxidants containing sulfur as a constituent element.

As examples of sulfurized fats and oils there may be mentioned oils such as sulfurized lard, sulfurized rapeseed oil, sulfurized castor oil, sulfurized soybean oil and sulfurized rice bran oil; disulfide fatty acids such as oleic sulfide; and sulfurized esters such as sulfurized methyl oleate.

Examples of olefin sulfides include C2-C15 olefins or their 2-4mers reacted with sulfidizing agents such as sulfur or sulfur chloride. Examples of olefins that are preferred for use include propylene, isobutene and diisobutene.

Specific preferred examples of dihydrocarbyl polysulfides include dibenzyl polysulfide, di-tert-nonyl polysulfide, didodecyl polysulfide, di-tert-butyl polysulfide, dioctyl polysulfide, diphenyl polysulfide and dicyclohexyl polysulfide.

As specific preferred examples of dithiocarbamates there may be mentioned, compounds represented by the following formula (6) or (7).

[Chemical Formula 1]

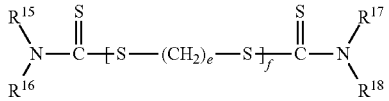

(6)

[Chemical Formula 2]

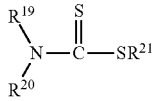

(7)

In formulas (6) and (7), $R^{15}$, $R^{16}$, $R^{17}$, $R^{18}$, $R^{19}$ and $R^{20}$ each separately represent a C1-C30 and preferably 1-20 hydrocarbon group, $R^{21}$ represents hydrogen or a C1-C30 hydrocarbon group and preferably hydrogen or a C1-C20 hydrocarbon group, e represents an integer of 0-4, and f represents an integer of 0-6.

Examples of C1-C30 hydrocarbon groups include alkyl, cycloalkyl, alkylcycloalkyl, alkenyl, aryl, alkylaryl and arylalkyl groups.

Examples of thiadiazoles include 1,3,4-thiadiazole compounds, 1,2,4-thiadiazole compounds and 1,4,5-thiadiazole compounds.

As phenol-based ash-free antioxidants containing sulfur as a constituent element there may be mentioned 4,4'-thiobis(2-methyl-6-tert-butylphenol), 4,4'-thiobis(3-methyl-6-tert-butylphenol), 2,2'-thiobis(4-methyl-6-tert-butylphenol), bis(3-methyl-4-hydroxy-5-tert-butylbenzyl)sulfide, bis(3,5-di-tert-butyl-4-hydroxybenzyl)sulfide, 2,2'-thio-diethylenebis[3-(3,5-di-tert-butyl-4-hydroxyphenyl)propionate] and the like.

Dihydrocarbyl polysulfides, dithiocarbamates and thiadiazoles are preferably used as component (B-1) from the viewpoint of achieving more excellent heat and oxidation stability.

When (B-1) an ash-free antioxidant containing sulfur as a constituent element is used as component (B) according to the invention, there are no particular restrictions on the content, but it is preferably 0.001% by mass or greater, more preferably 0.005% by mass or greater and even more preferably 0.01% by mass or greater, and preferably not greater than 0.2% by mass, more preferably not greater than 0.1% by mass and most preferably not greater than 0.04% by mass, in terms of sulfur element based on the total amount of the composition. If the content is less than the aforementioned lower limit, the heat and oxidation stability of the lubricating oil composition will be insufficient, and it may not be possible to maintain superior cleanability for prolonged periods. On the other hand, if it exceeds the aforementioned upper limit the adverse effects on exhaust gas purification apparatuses by the high sulfur content of the lubricating oil composition will tend to be increased.

The (B-2) organic molybdenum compounds that may be used as component (B) include (B-2-1) organic molybdenum compounds containing sulfur as a constituent element and (B-2-2) organic molybdenum compounds containing no sulfur as a constituent element.

Examples of (B-2-1) organic molybdenum compounds containing sulfur as a constituent element include organic molybdenum complexes such as molybdenum dithiophosphates and molybdenum dithiocarbamates.

Preferred examples of molybdenum dithiophosphates include, specifically, molybdenum sulfide-diethyl dithiophosphate, molybdenum sulfide-dipropyl dithiophosphate, molybdenum sulfide-dibutyl dithiophosphate, molybdenum sulfide-dipentyl dithiophosphate, molybdenum sulfide-dihexyl dithiophosphate, molybdenum sulfide-dioctyl dithiophosphate, molybdenum sulfide-didecyl dithiophosphate, molybdenum sulfide-didodecyl dithiophosphate, molybdenum sulfide-di(butylphenyl)dithiophosphate, molybdenum sulfide-di(nonylphenyl)dithiophosphate, oxymolybdenum sulfide-diethyl dithiophosphate, oxymolybdenum sulfide-dipropyl dithiophosphate, oxymolybdenum sulfide-dibutyl dithiophosphate, oxymolybdenum sulfide-dipentyl dithiophosphate, oxymolybdenum sulfide-dihexyl dithiophosphate, oxymolybdenum sulfide-dioctyl dithiophosphate, oxymolybdenum sulfide-didecyl dithiophosphate, oxymolybdenum sulfide-didodecyl dithiophosphate, oxymolybdenum sulfide-di(butylphenyl)dithiophosphate, oxymolybdenum sulfide-di(nonylphenyl)dithiophosphate (where the alkyl groups may be straight-chain or branched, and the alkyl groups may be bonded at any position of the alkylphenyl groups), as well as mixtures of the foregoing. Also preferred as molybdenum dithiophosphates are compounds with different numbers of carbon atoms or structural hydrocarbon groups in the molecule.

As specific examples of molybdenum dithiocarbamates there may be used compounds represented by the following formula (12).

[Chemical Formula 3]

(12)

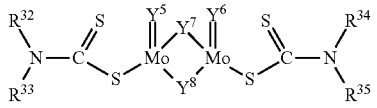

In formula (12), $R^{32}$, $R^{33}$, $R^{34}$ and $R^{35}$ may be the same or different and each represents a hydrocarbon group such as a C2-C24 and preferably C4-C13 alkyl group, or a C6-C24 and preferably C10-C15 (alkyl)aryl. $Y^5$, $Y^6$, $Y^7$ and $Y^8$ each represent a sulfur atom or oxygen atom.

Preferred examples of alkyl groups include ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl, which may be primary alkyl, secondary alkyl or tertiary alkyl groups, and either straight-chain or branched.

As molybdenum dithiocarbamates having structures other than those described above there may be mentioned compounds with structures in which dithiocarbamate groups are coordinated with thio- or polythio-trimeric molybdenum, as disclosed in WO98/26030 and WO99/31113.

As examples of preferred molybdenum dithiocarbamates there may be mentioned, specifically, molybdenum sulfide-diethyl dithiocarbamate, molybdenum sulfide-dipropyl dithiocarbamate, molybdenum sulfide-dibutyl dithiocarbamate, molybdenum sulfide-dipentyl dithiocarbamate, molybdenum sulfide-dihexyl dithiocarbamate, molybdenum sulfide-dioctyl dithiocarbamate, molybdenum sulfide-didecyl dithiocarbamate, molybdenum sulfide-didodecyl dithiocarbamate, molybdenum sulfide-di(butylphenyl)dithiocarbamate, molybdenum sulfide-di(nonylphenyl)dithiocarbamate, oxymolybdenum sulfide-diethyl dithiocarbamate, oxymolybdenum sulfide-dipropyl dithiocarbamate, oxymolybdenum sulfide-dibutyl dithiocarbamate, oxymolybdenum sulfide-dipentyl dithiocarbamate, oxymolybdenum sulfide-dihexyl dithiocarbamate, oxymolybdenum sulfide-dioctyl dithiocarbamate, oxymolybdenum sulfide-didecyl dithiocarbamate, oxymolybdenum sulfide-didodecyl dithiocarbamate, oxymolybdenum sulfide-di(butylphenyl)dithiocarbamate, oxymolybdenum sulfide-di(nonylphenyl)dithiocarbamate (where the alkyl groups may be linear or branched, and the alkyl groups may be bonded at any position of the alkylphenyl groups), as well as mixtures of the foregoing. Also preferred as molybdenum dithiocarbamates are compounds with different numbers of carbon atoms or structural hydrocarbon groups in the molecule.

As other sulfur-containing organic molybdenum complexes there may be mentioned complexes of molybdenum compounds (for example, molybdenum oxides such as molybdenum dioxide and molybdenum trioxide, molybdic acids such as orthomolybdic acid, paramolybdic acid and (poly)molybdic sulfide acid, molybdic acid salts such as metal salts or ammonium salts of these molybdic acids, molybdenum sulfides such as molybdenum disulfide, molybdenum trisulfide, molybdenum pentasulfide and polymolybdenum sulfide, molybdic sulfide, metal salts or amine salts of molybdic sulfide, halogenated molybdenums such as molybdenum chloride, and the like), with sulfur-containing organic compounds (for example, alkyl(thio)xanthates, thiadiazole, mercaptothiadiazole, thiocarbonates, tetrahydrocarbylthiuram disulfide, bis(di(thio)hydrocarbyldithiophosphonate) disulfide, organic (poly)sulfides, sulfurized esters and the like), or other organic compounds, or complexes of sulfur-containing molybdenum compounds such as molybdenum sulfide and molybdic sulfide mentioned above with alkenylsucciniimides.

Component (B) according to the invention is preferably a (B-2-1) organic molybdenum compound containing sulfur as a constituent element in order to obtain a friction reducing effect in addition to improving the heat and oxidation stability, with molybdenum dithiocarbamates being particularly preferred.

As the (B-2-2) organic molybdenum compounds containing no sulfur as a constituent element there may be mentioned, specifically, molybdenum-amine complexes, molybdenum-succiniimide complexes, organic acid molybdenum salts, alcohol molybdenum salts and the like, among which molybdenum-amine complexes, organic acid molybdenum salts and alcohol molybdenum salts are preferred.

As molybdenum compounds in the aforementioned molybdenum-amine complexes there may be mentioned sulfur-free molybdenum compounds such as molybdenum trioxide or its hydrate ($MoO_3.nH_2O$), molybdic acid ($H_2MoO_4$), alkali metal salts of molybdic acid ($M_2MoO_4$; where M represents an alkali metal), ammonium molybdate ($(NH_4)_2MoO_4$ or $(NH_4)_6[Mo_7O_{24}].4H_2O$), $MoCl_5$, $MoOCl_4$, $MoO_2Cl_2$, $MoO_2Br_2$, $Mo_2O_3Cl_6$ or the like. Of these molybdenum compounds, hexavalent molybdenum compounds are preferred from the viewpoint of yield of the molybdenum-amine complex. From the viewpoint of availability, the preferred hexavalent molybdenum compounds are molybdenum trioxide or its hydrate, molybdic acid, molybdic acid alkali metal salts and ammonium molybdenate.

There are no particular restrictions on nitrogen compounds for the molybdenum-amine complex, but as specific nitrogen compounds there may be mentioned ammonia, monoamines, diamines, polyamines, and the like. More specific examples include alkylamines with C1-C30 alkyl groups (where the alkyl groups may be straight-chain or branched); alkenylamines with C2-C30 alkenyl groups such as octenylamine and oleylamine (where the alkenyl groups may be straight-chain or branched); alkanolamines with C1-C30 alkanol groups (where the alkanol groups may be straight-chain or branched); alkylenediamines with C1-C30 alkylene groups; polyamines such as diethylenetriamine, triethylenetetramine, tetraethylenepentamine and pentaethylenehexamine; compounds with C8-C20 alkyl or alkenyl groups in the aforementioned monoamines, diamines and polyamines, such as dodecyldipropanolamine, oleyldiethanolamine, oleylpropylenediamine and stearyltetraethylenepentamine, or heterocyclic compounds such as N-hydroxyethyloleylimidazoline; and alkylene oxide addition products of these compounds, and mixtures of the foregoing. Primary amines, secondary amines and alkanolamines are preferred among those mentioned above.

The number of carbon atoms in the hydrocarbon group of the amine compound composing the molybdenum-amine complex is preferably 4 or greater, more preferably 4-30 and most preferably 8-18. If the hydrocarbon group of the amine compound has less than 4 carbon atoms, the solubility will tend to be poor. Limiting the number of carbon atoms in the amine compound to not greater than 30 will allow the molybdenum content in the molybdenum-amine complex to be relatively increased, so that the effect of the invention can be enhanced with a small amount of addition.

As molybdenum-succiniimide complexes there may be mentioned complexes of the sulfur-free molybdenum compounds mentioned above for the molybdenum-amine complexes, and succiniimides with C4 or greater alkyl or alkenyl groups. As succiniimides there may be mentioned succiniimides having at least one C40-C400 alkyl or alkenyl group in the molecule, or their derivatives, and preferably succiniimides with C4-C39 and more preferably C8-C18 alkyl or alkenyl groups.

As molybdenum salts of organic acids there may be mentioned salts of organic acids with molybdenum bases such as molybdenum oxides or molybdenum hydroxides, molybdenum carbonates or molybdenum chlorides, mentioned above as examples for the molybdenum-amine complexes. As organic acids there are preferred the phosphorus compounds and carboxylic acids represented by the following formula (P-1) or (P-2).

[Chemical Formula 4]

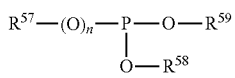

(P-1)

[In formula (P-1), $R^{57}$ represents a C1-C30 hydrocarbon group, $R^{58}$ and $R^{59}$ may be the same or different and each represents hydrogen or a C1-C30 hydrocarbon group, and n represents 0 or 1.]

[Chemical Formula 5]

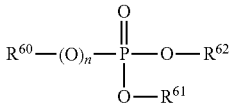

(P-2)

[In formula (P-2), $R^{60}$, $R^{61}$ and $R^{62}$ may be the same or different and each represents hydrogen or a C1-C30 hydrocarbon group, and n represents 0 or 1.]

The carboxylic acid in a molybdenum salt of a carboxylic acid may be either a monobasic acid or polybasic acid.

As monobasic acids there may be used C2-C30 and preferably C4-C24 fatty acids, which may be straight-chain or branched and saturated or unsaturated.

The monobasic acid may be a monocyclic or polycyclic carboxylic acid (optionally with hydroxyl groups) in addition to any of the aforementioned fatty acids, and the number of carbon atoms is preferably 4-30 and more preferably 7-30. As preferred examples of monocyclic or polycyclic carboxylic acids there may be mentioned benzoic acid, salicylic acid, alkylbenzoic acids, alkylsalicylic acids, cyclohexanecarboxylic acid and the like.

As polybasic acids there may be mentioned dibasic acids, tribasic acids and tetrabasic acids. The polybasic acids may be linear polybasic acids or cyclic polybasic acids. In the case of a linear polybasic acid, it may be straight-chain or branched and either saturated or unsaturated. As linear polybasic acids there are preferred C2-C16 linear dibasic acids. As cyclic polybasic acids there may be mentioned alicyclic dicarboxylic acids such as 1,2-cyclohexanedicarboxylic acid and 4-cyclohexene-1,2-dicarboxylic acid, aromatic dicarboxylic acids such as phthalic acid, aromatic tricarboxylic acids such as trimellitic acid and aromatic tetracarboxylic acids such as pyromellitic acid.

As molybdenum salts of alcohols there may be mentioned salts of alcohols with the sulfur-free molybdenum compounds mentioned above for the molybdenum-amine complexes, and the alcohols may be monohydric alcohol, polyhydric alcohol or polyhydric alcohol partial esters or partial ester compounds or hydroxyl group-containing nitrogen compounds (alkanolamines and the like). Molybdic acid is a strong acid and forms esters by reaction with alcohols, and esters of molybdic acid with alcohols are also included within the molybdenum salts of alcohols according to the invention.

As monohydric alcohols there may be used C1-C24, preferably C1-C12 and more preferably C1-C8 monohydric alcohols, and such alcohols may be straight-chain or branched, and either saturated or unsaturated.

As polyhydric alcohols there may be used C2-C10 and preferably C2-C6 polyhydric alcohols.

As partial esters of polyhydric alcohols there may be mentioned polyhydric alcohols having some of the hydroxyl groups hydrocarbylesterified, among which glycerin monooleate, glycerin dioleate, sorbitan monooleate, sorbitan dioleate, pentaerythritol monooleate, polyethyleneglycol monooleate and polyglycerin monooleate are preferred.

As partial ethers of polyhydric alcohols there may be mentioned the polyhydric alcohols mentioned above as polyhydric alcohols having some of the hydroxyl groups hydrocarbyletherified, and compounds having ether bonds formed by condensation between polyhydric alcohols (sorbitan condensation products and the like), among which 3-octadecyloxy-1,2-propanediol, 3-octadecenyloxy-1,2-propanediol, polyethyleneglycol alkyl ethers are preferred.

As hydroxyl group-containing nitrogen compounds there may be mentioned the examples of alkanolamines for the molybdenum-amine complexes referred to above, as well as alkanolamides wherein the amino groups on the alkanols are amidated (diethanolamide and the like), among which stearyldiethanolamine, polyethyleneglycol stearylamine, polyethyleneglycol dioleylamine, hydroxyethyllaurylamine, diethanolamide oleate and the like are preferred.

When a (B-2-2) organic molybdenum compound containing no sulfur as a constituent element is used as component (B) according to the invention it is possible to increase the high-temperature cleanability and base number retention of the lubricating oil composition, and this is preferred for maintaining the initial friction reducing effect for longer periods, while molybdenum-amine complexes are especially preferred among such compounds.

The (B-2-1) organic molybdenum compound containing sulfur as a constituent element and (B-2-2) organic molybdenum compound containing no sulfur as a constituent element may also be used in combination for the invention.

When (B) an organic molybdenum compound is used as component (B) according to the invention, there are no particular restrictions on the content, but it is preferably 0.001% by mass or greater, more preferably 0.005% by mass or greater and even more preferably 0.01% by mass or greater, and preferably not greater than 0.2% by mass, more preferably not greater than 0.1% by mass and most preferably not greater than 0.04% by mass, in terms of molybdenum element based on the total amount of the composition. If the content is less than 0.001% by mass the heat and oxidation stability of the lubricating oil composition will be insufficient, and in particular it may not be possible to maintain superior cleanability for prolonged periods. On the other hand, if the content of component (B-1) is greater than 0.2% by mass the effect will not be commensurate with the increased amount, and the storage stability of the lubricating oil composition will tend to be reduced.

The lubricating oil composition for an internal combustion engine according to the invention may consist entirely of the lubricating base oil and components (A) and (B) described above, but it may further contain the additives described below as necessary for further enhancement of function.

The lubricating oil composition for an internal combustion engine according to the invention preferably also further contains an anti-wear agent from the viewpoint of greater enhancement of the wear resistance. As extreme-pressure agents there are preferably used phosphorus-based extreme-pressure agents and phosphorus/sulfur-based extreme-pressure agents.

As phosphorus-based extreme-pressure agents there may be mentioned phosphoric acid, phosphorous acid, phosphoric acid esters (including phosphoric acid monoesters, phosphoric acid diesters and phosphoric acid triesters), phosphorous acid esters (including phosphorous acid monoesters, phosphorous acid diesters and phosphorous acid triesters), and salts of the foregoing (such as amine salts or metal salts). As phosphoric acid esters and phosphorous acid esters there may generally be used those with C2-C30 and preferably C3-C20 hydrocarbon groups.

As phosphorus/sulfur-based extreme-pressure agents there may be mentioned thiophosphoric acid, thiophosphorous acid, thiophosphoric acid esters (including thiophosphoric acid monoesters, thiophosphoric acid diesters and thiophosphoric acid triesters), thiophosphorous acid esters (including thiophosphorous acid monoesters, thiophosphorous acid diesters and thiophosphorous acid triesters), salts of the foregoing, and zinc dithiophosphate. As thiophosphoric acid esters and thiophosphorous acid esters there may generally be used those with C2-C30 and preferably C3-C20 hydrocarbon groups.

There are no particular restrictions on the extreme-pressure agent content, but it is preferably 0.01-5% by mass and more preferably 0.1-3% by mass based on the total amount of the composition.

Among the extreme-pressure agents mentioned above, zinc dithiophosphates are especially preferred for the invention. Examples of zinc dithiophosphates include compounds represented by the following formula (13).

[Chemical Formula 6]

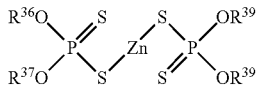

(13)

$R^{36}$, $R^{37}$, $R^{38}$ and $R^{39}$ in formula (13) each separately represent a C1-C24 hydrocarbon group. The hydrocarbon groups are preferably C1-C24 straight-chain or branched alkyl, C3-C24 straight-chain or branched alkenyl, C5-C13 cycloalkyl or straight-chain or branched alkylcycloalkyl, C6-C18 aryl or straight-chain or branched alkylaryl, and C7-C19 arylalkyl groups. The alkyl groups or alkenyl groups may be primary, secondary or tertiary.

Specific preferred examples of zinc dithiophosphates include zinc diisopropyldithiophosphate, zinc diisobutyldithiophosphate, zinc di-sec-butyldithiophosphate, zinc di-sec-pentyldithiophosphate, zinc di-n-hexyldithiophosphate, zinc di-sec-hexyldithiophosphate, zinc di-octyldithiophosphate, zinc di-2-ethylhexyldithiophosphate, zinc di-n-decyldithiophosphate, zinc di-n-dodecyldithiophosphate, zinc diisotridecyldithiophosphate, and any desired combinations of the foregoing.

The process for producing the zinc dithiophosphate is not particularly restricted, and it may be produced by any desired conventional method. Specifically, it may be synthesized, for example, by reacting an alcohol or phenol containing hydrocarbon groups corresponding to $R^{36}$, $R^{37}$, $R^{38}$ and $R^{39}$ in formula (13) above with diphosphorus pentasulfide to produce a dithiophosphoric acid, and neutralizing it with zinc oxide. The structure of the zinc dithiophosphate will differ depending on the starting alcohol used.

The content of the zinc dithiophosphate is not particularly restricted, but from the viewpoint of inhibiting catalyst poisoning of the exhaust gas purification device, it is preferably not greater than 0.2% by mass, more preferably not greater than 0.1% by mass, even more preferably not greater than 0.08% by mass and most preferably not greater than 0.06% by mass in terms of phosphorus element based on the total amount of the composition. From the viewpoint of forming a metal salt of phosphoric acid that will exhibit a function and effect as an anti-wear additive, the content of the zinc dithiophosphate is preferably 0.01% by mass or greater, more preferably 0.02% by mass or greater and even more preferably 0.04% by mass or greater as phosphorus element based on the total amount of the composition. If the zinc dithiophosphate content is less than the aforementioned lower limit, the wear resistance improving effect of its addition will tend to be insufficient.

The lubricating oil composition for an internal combustion engine according to the invention preferably further contains an ash-free dispersant from the viewpoint of cleanability and sludge dispersibility. As such ash-free dispersants there may be mentioned alkenylsucciniimides and alkylsucciniimides derived from polyolefins, and their derivatives. A typical succiniimide can be obtained by reacting succinic anhydride substituted with a high molecular weight alkenyl group or alkyl group, with a polyalkylenepolyamine containing an average of 4-10 (preferably 5-7) nitrogen atoms per molecule. The high molecular weight alkenyl group or alkyl group is preferably polybutene (polyisobutene) with a number-average molecular weight of 700-5000, and more preferably polybutene (polyisobutene) with a number-average molecular weight of 900-3000.

As examples of preferred polybutenylsucciniimides to be used in the lubricating oil composition for an internal combustion engine according to the invention there may be mentioned compounds represented by the following formulas (14) and (15).

[Chemical Formula 7]

(14)

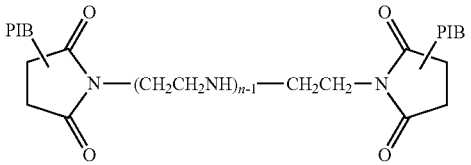

[Chemical Formula 8]

(15)

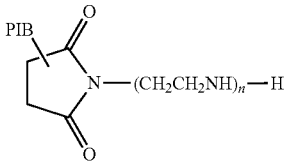

The PIB in formulas (14) and (15) represent polybutenyl groups, which are obtained from polybutene produced by polymerizing high purity isobutene or a mixture of 1-butene and isobutene with a boron fluoride-based catalyst or aluminum chloride-based catalyst, and the polybutene mixture will usually include 5-100% by mole molecules with vinylidene structures at the ends. Also, from the viewpoint of obtaining a sludge-inhibiting effect, n is an integer of 2-5 and preferably an integer of 3-4.

There are no particular restrictions on the method of producing the succiniimide represented by formula (14) or (15), and for example, polybutenylsuccinic acid obtained by reacting a chlorinated product of the aforementioned polybutene, preferably highly reactive polybutene (polyisobutene), having the aforementioned high purity isobutene polymerized with a boron fluoride-based catalyst, and more preferably polybutene that has been thoroughly depleted of chlorine or fluorine, with maleic anhydride at 100-200° C., may be reacted with a polyamine such as diethylenetriamine, triethylenetetramine, tetraethylenepentamine or pentaethylenehexamine. The polybutenylsuccinic acid may be reacted with a two-fold (molar ratio) amount of polyamine for production of bis succiniimide, or the polybutenylsuccinic acid may be reacted with an equivalent (equimolar) amount of polyamine for production of a mono succiniimide. From the viewpoint of achieving excellent sludge dispersibility, a polybutenylbis succiniimide is preferred.

Since trace amounts of fluorine or chlorine can remain in the polybutene used in the production process described above as a result of the catalyst used in the process, it is preferred to use polybutene that has been thoroughly depleted of fluorine or chlorine by an appropriate method such as adsorption or thorough washing with water. The fluorine or chlorine content is preferably not greater than 50 ppm by mass, more preferably not greater than 10 ppm by mass, even more preferably not greater than 5 ppm by mass and most preferably not greater than 1 ppm by mass.

In processes where polybutene is reacted with maleic anhydride to obtain polybutenylsuccinic anhydride, it has been the common practice to employ a chlorination method using chlorine. However, such methods result in significant chlorine residue (for example, approximately 2000-3000 ppm) in the final succiniimide product. On the other hand, methods that employ no chlorine, such as methods using highly reactive polybutene and/or thermal reaction processes, can limit residual chlorine in the final product to extremely low levels (for example, 0-30 ppm). In order to reduce the chlorine content in the lubricating oil composition to within a range of 0-30 ppm by mass, therefore, it is preferred to use polybutenylsuccinic anhydride obtained not by the aforementioned chlorination method but by a method using the aforementioned highly reactive polybutene and/or a thermal reaction process.

As polybutenyl succiniimide derivatives there may be used "modified" succiniimides obtained by reacting boron compounds such as boric acid or oxygen-containing organic compounds such as alcohols, aldehydes, ketones, alkylphenols, cyclic carbonates, organic acids and the like with compounds represented by general formula (14) or (15) above, and neutralizing or amidating all or a portion of the residual amino groups and/or imino groups. Particularly advantageous from the viewpoint of heat and oxidation stability are boron-containing alkenyl (or alkyl) succiniimides obtained by reaction with boron compounds such as boric acid.

As boron compounds to be reacted with the compound represented by formula (14) or (15) there may be mentioned boric acid, boric acid salts, boric acid esters and the like. As specific examples of boric acids there may be mentioned orthoboric acid, metaboric acid and tetraboric acid. Succiniimide derivatives reacted with such boron compounds are preferred for superior heat resistance and oxidation stability.

As examples of oxygen-containing organic compounds to be reacted with the compound represented by formula (14) or (15) there may be mentioned, specifically, C1-C30 monocarboxylic acids such as formic acid, acetic acid, glycolic acid, propionic acid, lactic acid, butyric acid, valeric acid, caproic acid, enanthic acid, caprylic acid, pelargonic acid, capric acid, undecylic acid, lauric acid, tridecanoic acid, myristic acid, pentadecanoic acid, palmitic acid, margaric acid, stearic acid, oleic acid, nonadecanoic acid and eicosanoic acid, C2-C30 polycarboxylic acids such as oxalic acid, phthalic acid, trimellitic acid and pyromellitic acid or their anhydrides or ester compounds, and C2-C6 alkylene oxides, hydroxy (poly)oxyalkylene carbonates and the like. Preferred among these from the viewpoint of excellent sludge dispersibility are polybutenylbis succiniimides, composed mainly of product from reaction of these oxygen-containing organic compounds with all of the amino groups or imino groups. Such compounds can be obtained by reacting, for example, (n−1) moles of an oxygen-containing organic compound with 1 mol of the compound represented by formula (14) or formula (15), for example. Succiniimide derivatives obtained by reaction with such oxygen-containing organic compounds have excellent sludge dispersibility, and those reacted with hydroxy (poly)oxyalkylene carbonate are especially preferred.

The weight-average molecular weight of the polybutenyl succiniimide and/or its derivative as an ash-free dispersant used for the invention is preferably 5000 or greater, more preferably 6500 or greater, even more preferably 7000 or greater and most preferably 8000 or greater. With a weight-average molecular weight of less than 5000, the molecular weight of the non-polar group polybutenyl groups will be low and the sludge dispersibility will be poor, while the oxidation stability will be inferior due to a higher proportion of amine portions of the polar groups, which can act as active sites for oxidative degradation, such that the usable life-lengthening effect of the invention may not be achieved. On the other hand, from the viewpoint of preventing reduction of the low-temperature viscosity characteristic, the weight-average molecular weight of the polybutenyl succiniimide and/or its derivative is preferably not greater than 20,000 and most preferably not greater than 15,000. The weight-average molecular weight referred to here is the weight-average molecular weight based on polystyrene, as measured using a 150-CALC/GPC by Japan Waters Co., equipped with two GMHHR-M (7.8 mmID×30 cm) columns by Tosoh Corp. in series, with tetrahydrofuran as the solvent, a temperature of 23° C., a flow rate of 1 mL/min, a sample concentration of 1% by mass, a sample injection rate of 75 μL and a differential refractometer (RI) as the detector.

According to the invention, the ash-free dispersant used may be, in addition to the aforementioned succiniimide and/or its derivative, an alkyl or alkenylpolyamine, alkyl or alkenylbenzylamine, alkyl or alkenylsuccinic acid ester, Mannich base, or a derivative thereof.

The ash-free dispersant content of the lubricating oil composition for an internal combustion engine according to the invention is preferably 0.005% by mass or greater, more preferably 0.01% by mass or greater and even more preferably 0.05% by mass or greater, and preferably not greater than 0.3% by mass, more preferably not greater than 0.2% by mass and even more preferably not greater than 0.015% by mass, in terms of nitrogen element based on the total amount of the composition. If the ash-free dispersant r content is not above the aforementioned lower limit a sufficient effect on cleanability will not be exhibited, while if the content exceeds the aforementioned upper limit, the low-temperature viscosity characteristic and demulsifying property will be undesirably impaired. When using an imide-based succinate ash-free dispersant with a weight-average molecular weight of 6500 or greater, the content is preferably 0.005-0.05% by mass and more preferably 0.01-0.04% by mass as nitrogen element based on the total amount of the composition, from the viewpoint of exhibiting sufficient sludge dispersibility and achieving an excellent low-temperature viscosity characteristic.

When a high molecular weight ash-free dispersant is used, the content is preferably 0.005% by mass or greater and more preferably 0.01% by mass or greater, and preferably not greater than 0.1% by mass and more preferably not greater than 0.05% by mass, in terms of nitrogen element based on the total amount of the composition. If the high molecular weight ash-free dispersant content is not above the aforementioned lower limit a sufficient effect on cleanability will not be exhibited, while if the content exceeds the aforementioned upper limit the low-temperature viscosity characteristic and demulsifying property will both be undesirably impaired.

When a boron compound-modified ash-free dispersant is used, the content is preferably 0.005% by mass or greater, more preferably 0.01% by mass or greater and even more preferably 0.02% by mass or greater, and preferably not greater than 0.2% by mass and more preferably not greater than 0.1% by mass, in terms of boron element based on the total amount of the composition. If the boron compound-modified ash-free dispersant content is not above the aforementioned lower limit a sufficient effect on cleanability will not be exhibited, while if the content exceeds the aforementioned upper limit the low-temperature viscosity characteristic and demulsifying property will both be undesirably impaired.

The lubricating oil composition for an internal combustion engine according to the invention preferably contains an ash-free friction modifier to allow further improvement in the frictional properties. The ash-free friction modifier used may be any compound ordinarily used as a friction modifier for lubricating oils, and as examples there may be mentioned ash-free friction modifiers that are amine compounds, fatty acid esters, fatty acid amides, fatty acids, aliphatic alcohols, aliphatic ethers, hydrazide (such as oleyl hydrazide), semicarbazides, ureas, ureidos, biurets and the like having one or more C6-C30 alkyl or alkenyl and especially C6-C30 straight-chain alkyl or straight-chain alkenyl groups in the molecule.

The friction modifier content of the lubricating oil composition for an internal combustion engine according to the invention is preferably 0.01% by mass or greater, more preferably 0.1% by mass or greater and even more preferably 0.3% by mass or greater, and preferably not greater than 3% by mass, more preferably not greater than 2% by mass and even more preferably not greater than 1% by mass, based on the total amount of the composition. If the friction modifier content is less than the aforementioned lower limit the friction reducing effect by the addition will tend to be insufficient, while if it is greater than the aforementioned upper limit, the effects of the anti-wear additives may be inhibited, or the solubility of the additives may be reduced.

The lubricating oil composition for an internal combustion engine according to the invention preferably further contains a metal-based detergent from the viewpoint of cleanability. The metal-based detergent used is preferably at least one alkaline earth metal-based detergent selected from among alkaline earth metal sulfonates, alkaline earth metal phenates and alkaline earth metal salicylates.

As alkaline earth metal sulfonates there may be mentioned alkaline earth metal salts, especially magnesium salts and/or calcium salts, and preferably calcium salts, of alkylaromatic sulfonic acids obtained by sulfonation of alkyl aromatic compounds with a molecular weight of 300-1,500 and preferably 400-700. As such alkylaromatic sulfonic acids there may be mentioned, specifically, petroleum sulfonic acids and synthetic sulfonic acids. As petroleum sulfonic acids there may be used sulfonated alkyl aromatic compounds from mineral oil lube-oil distillates, or "mahogany acids" that are by-products of white oil production. Examples of synthetic sulfonic acids that may be used include sulfonated products of alkylbenzenes with straight-chain or branched alkyl groups, either as by-products of alkylbenzene production plants that are used as starting materials for detergents or obtained by alkylation of polyolefins onto benzene, or sulfonated alkylnaphthalenes such as sulfonated dinonylnaphthalenes. There are no particular restrictions on the sulfonating agent used for sulfonation of these alkyl aromatic compounds, but for most purposes fuming sulfuric acid or sulfuric anhydride may be used.

As alkaline earth metal phenates there may be mentioned alkaline earth metal salts, and especially magnesium salts and/or calcium salts, of alkylphenols, alkylphenol sulfides and alkylphenol Mannich reaction products.

As alkaline earth metal salicylates there may be mentioned alkaline earth metal salts, and especially magnesium salts and/or calcium salts, of alkylsalicylic acids.

Alkaline earth metal sulfonates, alkaline earth metal phenates and alkaline earth metal salicylates include not only neutral (normal salt) alkaline earth metal sulfonates, neutral (normal salt) alkaline earth metal phenates and neutral (normal salt) alkaline earth metal salicylates obtained by reacting the aforementioned alkylaromatic sulfonic acids, alkylphenols, alkylphenol sulfides, alkylphenol Mannich reaction products and alkylsalicylic acids directly with alkaline earth metal bases such as oxides or hydroxides of alkaline earth metals such as magnesium and/or calcium, or by first forming alkali metal salts such as sodium salts or potassium salts and then replacing them with alkaline earth metal salts, but also basic alkaline earth metal sulfonates, basic alkaline earth metal phenates and basic alkaline earth metal salicylates obtained by heating neutral alkaline earth metal sulfonates, neutral alkaline earth metal phenates and neutral alkaline earth metal salicylates with an excess of alkaline earth metal salts or alkaline earth metal bases in the presence of water, and overbased alkaline earth metal sulfonates, overbased alkaline earth metal phenates and overbased alkaline earth metal salicylates obtained by reacting alkaline earth metal hydroxides with carbon dioxide gas or boric acid in the presence of neutral alkaline earth metal sulfonates, neutral alkaline earth metal phenates and neutral alkaline earth metal salicylates.

According to the invention, the aforementioned neutral alkaline earth metal salts, basic alkaline earth metal salts, overbased alkaline earth metal salts or mixtures thereof may be used. Of these, combinations of overbased calcium sulfonate and overbased calcium phenate, or overbased calcium salicylate, are preferably used and overbased calcium salicylate is most preferably used, from the viewpoint of maintaining cleanability for prolonged periods. Metal-based detergents are generally marketed or otherwise available in forms diluted with light lubricating base oils, and for most purposes the metal content will be 1.0-20% by mass and preferably 2.0-16% by mass. The alkaline earth metal-based detergent used for the invention may have any total base number, but for most purposes the total base number is not greater than 500 mgKOH/g and preferably 150-450 mgKOH/g. The total base number referred to here is the total base number determined by the perchloric acid method, as measured according to JIS K2501 (1992): "Petroleum Product And Lubricating Oils—Neutralization Value Test Method", Section 7.

The metal-based detergent content of the lubricating oil composition for an internal combustion engine according to the invention may be as desired, but it is preferably 0.1-10% by mass, more preferably 0.5-8% by mass and most preferably 1-5% by mass based on the total amount of the composition. A content of greater than 10% by mass will produce no effect commensurate with the increased addition, and is therefore undesirable.

The lubricating oil composition for an internal combustion engine according to the invention preferably contains a viscosity index improver to allow further improvement in the viscosity-temperature characteristic. As viscosity index improvers there may be mentioned non-dispersed or dispersed polymethacrylates, dispersed ethylene-α-olefin copolymers and their hydrides, polyisobutylene and its hydride, styrene-diene hydrogenated copolymers, styrene-maleic anhydride ester copolymers and polyalkylstyrenes, among which non-dispersed viscosity index improvers and/or dispersed viscosity index improvers with weight-average molecular weights of not greater than 50,000, preferably not greater than 40,000 and most preferably 10,000-35,000 are preferred.

Of the viscosity index improvers mentioned above, polymethacrylate-based viscosity index improvers are preferred from the viewpoint of a superior cold flow property.

The viscosity index improver content of the lubricating oil composition for an internal combustion engine according to the invention is preferably 0.1-15% by mass and more preferably 0.5-5% by mass based on the total amount of the composition. If the viscosity index improver content is less than 0.1% by mass, the improving effect on the viscosity-temperature characteristic by its addition will tend to be insufficient, while if it exceeds 10% by mass it will tend to be difficult to maintain the initial extreme-pressure property for long periods.

If necessary in order to improve performance, other additives in addition to those mentioned above may be added to the lubricating oil composition for an internal combustion engine according to the invention, and such additives may include corrosion inhibitors, rust-preventive agents, demulsifiers, metal deactivating agents, pour point depressants, rubber swelling agents, antifoaming agents, coloring agents and the like, either alone or in combinations of two or more.

Examples of corrosion inhibitors include benzotriazole-based, tolyltriazole-based, thiadiazole-based and imidazole-based compounds.

Examples of rust-preventive agents include petroleum sulfonates, alkylbenzene sulfonates, dinonylnaphthalene sulfonates, alkenylsuccinic acid esters and polyhydric alcohol esters.

Examples of demulsifiers include polyalkylene glycol-based nonionic surfactants such as polyoxyethylenealkyl ethers, polyoxyethylenealkylphenyl ethers and polyoxyethylenealkylnaphthyl ethers.

Examples of metal deactivating agents include imidazolines, pyrimidine derivatives, alkylthiadiazoles, mercaptobenzothiazoles, benzotriazole and its derivatives, 1,3,4-thiadiazolepolysulfide, 1,3,4-thiadiazolyl-2,5-bisdialkyl dithiocarbamate, 2-(alkyldithio)benzimidazole and β-(o-carboxybenzylthio)propionitrile.

Any publicly known pour point depressants may be selected as pour point depressants depending on the properties of the lubricating base oil, but preferred are polymethacrylates with weight-average molecular weights of 1-300,000 and preferably 5-200,000.

According to the invention, it is possible to achieve a particularly excellent low-temperature viscosity characteristic (a MRV viscosity at −40° C. of preferably not greater than 20,000 mPa·s, more preferably not greater than 15,000 mPa·s and even more preferably not greater than 10,000 mPa·s) since the effect of adding the pour point depressant is maximized by the lubricating base oil of the invention. The MRV viscosity at −40° C. is the MRV viscosity at −40° C. measured according to JPI-5S-42-93. When a pour point depressant is added to base oils (II) and (V), for example, it is possible to obtain a lubricating oil composition having a highly excellent low-temperature viscosity characteristic wherein the MRV viscosity at −40° C. is not greater than 12,000 mPa·s, more preferably not greater than 10,000 mPa·s, even more preferably 8000 mPa·s and most preferably not greater than 6500 mPa·s. In this case, the content of the pour point depressant is 0.05-2% by mass and preferably 0.1-1.5% by mass based on the total amount of the composition, but it is most ideally in the range of 0.15-0.8% by mass from the viewpoint of allowing reduction in the MRV viscosity.

As antifoaming agents there may be used any compounds commonly employed as antifoaming agents for lubricating oils, and examples include silicones such as dimethylsilicone and fluorosilicone. Any one or more selected from these compounds may be added in any desired amount.

As coloring agents there may be used any normally employed compounds and in any desired amounts, although the contents will usually be 0.001-1.0% by mass based on the total amount of the composition.

When such additives are added to a lubricating oil composition of the invention, the contents will normally be selected in ranges of 0.005-5% by mass for corrosion inhibitors, rust-preventive agents and demulsifiers, 0.005-1% by mass for metal deactivating agents, 0.05-1% by mass for pour point depressants, 0.0005-1% by mass for antifoaming agents and 0.001-1.0% by mass for coloring agents, based on the total amount of the composition.

The lubricating oil composition for an internal combustion engine according to the invention may include additives containing sulfur as a constituent element, as explained above, but the total sulfur content of the lubricating oil composition (the total of sulfur from the lubricating base oil and additives) is preferably 0.05-0.3% by mass, more preferably 0.1-0.2% by mass and most preferably 0.12-0.18% by mass, from the viewpoint of solubility of the additives and of exhausting the base number resulting from production of sulfur oxides under high-temperature oxidizing conditions.

The kinematic viscosity at 100° C. of the lubricating oil composition for an internal combustion engine according to the invention will normally be 4-24 $mm^2/s$, but from the viewpoint of maintaining the oil film thickness which prevents seizing and wear and the viewpoint of inhibiting increase in stirring resistance, it is preferably 5-18 $mm^2/s$, more preferably 6-15 $mm^2/s$ and even more preferably 7-12 $mm^2/s$.

The lubricating oil composition for an internal combustion engine according to the invention having the construction described above has excellent heat and oxidation stability, as well as superiority in terms of viscosity-temperature characteristic, frictional properties and low volatility, and exhibits an adequate long drain property and energy savings when used as a lubricating oil for an internal combustion engine, such as a gasoline engine, diesel engine, oxygen-containing compound-containing fuel engine or gas engine for two-wheel vehicles, four-wheel vehicles, electric power generation, ships and the like.

EXAMPLES

The present invention will now be explained in greater detail based on examples and comparative examples, with the understanding that these examples are in no way limitative on the invention.

[Crude Wax]

The fraction separated by vacuum distillation in a process for refining of a solvent refined base oil was subjected to solvent extraction with furfural and then hydrotreatment, which was followed by solvent dewaxing with a methyl ethyl ketone-toluene mixed solvent. The properties of the wax portion removed during solvent dewaxing and obtained as slack wax (hereunder, "WAX1") are shown in Table 1.

TABLE 1

| | Name of crude wax WAX1 |
|---|---|
| Kinematic viscosity at 100° C. ($mm^2/s$) | 6.3 |
| Melting point (° C.) | 53 |
| Oil content (% by mass) | 19.9 |
| Sulfur content (ppm by mass) | 1900 |

The properties of the wax portion obtained by further deoiling of WAX1 (hereunder, "WAX2") are shown in Table 2.

TABLE 2

| | Name of crude wax WAX2 |
|---|---|
| Kinematic viscosity at 100° C. ($mm^2/s$) | 6.8 |
| Melting point (° C.) | 58 |
| Oil content (% by mass) | 6.3 |
| Sulfur content (ppm by mass) | 900 |

An FT wax having a paraffin content of 95% by mass and a carbon number distribution from 20 to 80 (hereunder, "WAX3") was used, and the properties of WAX3 are shown in Table 3.

TABLE 3

| | Name of crude wax WAX3 |
|---|---|
| Kinematic viscosity at 100° C. ($mm^2/s$) | 5.8 |
| Melting point (° C.) | 70 |
| Oil content (% by mass) | <1 |
| Sulfur content (ppm by mass) | <0.2 |

[Production of Lubricating Base Oils]

WAX1, WAX2 and WAX3 were used as feedstock oils for hydrotreatment with a hydrotreatment catalyst. The reaction temperature and liquid space velocity during this time were controlled for a cracking severity of not greater than 10% by mass for the normal paraffins in the feedstock oil.

Next, the treated product obtained from the hydrotreatment was subjected to hydrodewaxing in a temperature range of 315° C.-325° C. using a zeolite-based hydrodewaxing catalyst adjusted to a precious metal content of 0.1-5% by mass.

The treated product (raffinate) obtained by this hydrodewaxing was subsequently treated by hydrorefining using a hydrorefining catalyst. Next, the light and heavy portions were separated by distillation to obtain a lubricating base oil having the composition and properties shown in Table 4. In Table 4, the row headed "Proportion of normal paraffin-derived components in urea adduct" means the values obtained by gas chromatography of the urea adduct obtained during measurement of the urea adduct value (same hereunder).

A polymethacrylate-based pour point depressant (weight-average molecular weight: approximately 60,000) commonly used in automobile lubricating oils was added to the lubricating base oils listed in Table 4. The pour point depressant was added in three different amounts of 0.3% by mass, 0.5% by mass and 1.0% by mass, based on the total amount of the composition. The MRV viscosity at −40° C. of each of the obtained lubricating oil compositions was then measured, and the obtained results are shown in Table 4.

TABLE 4

| | | Base oil 1-1 | Base oil 1-2 | Base oil 1-3 |
|---|---|---|---|---|
| Feedstock oil | | WAX1 | WAX2 | WAX3 |
| Urea adduct value, % by mass | | 1.25 | 1.22 | 1.18 |
| Proportion of normal paraffin-derived components in urea adduct, % by mass | | 2.4 | 2.5 | 2.5 |
| Base oil composition (based on total amount of base oil) | Saturated components, % by mass | 99.6 | 99.8 | 99.8 |
| | Aromatic components, % by mass | 0.2 | 0.1 | 0.1 |
| | Polar compound components, % by mass | 0.2 | 0.1 | 0.1 |
| Saturated compounds content (based on total amount of saturated components) | Cyclic saturated components, % by mass | 10.2 | 11.5 | 11.5 |
| | Acyclic saturated components, % by mass | 89.8 | 88.5 | 88.5 |
| Acyclic saturated components content (based on total amount of base oil) | Normal paraffins, % by mass | 0 | 0 | 0 |
| | Isoparaffins, % by mass | 89.1 | 88.3 | 88.3 |
| Acyclic saturated components content (based on total amount of acyclic saturated components) | Normal paraffins, % by mass | 0 | 0 | 0 |
| | Isoparaffins, % by mass | 100 | 100 | 100 |
| Sulfur content, ppm by mass | | <1 | <1 | <10 |
| Nitrogen content, ppm by mass | | <3 | <3 | <3 |
| Dynamic viscosity (40° C.), $mm^2/s$ | | 15.80 | 15.99 | 15.92 |
| Kinematic viscosity (100° C.), $mm^2/s$ | | 3.854 | 3.880 | 3.900 |
| Viscosity index | | 141 | 141 | 142 |
| Density (15° C.), $g/cm^3$ | | 0.8195 | 0.8197 | 0.8170 |
| Pour point, ° C. | | −22.5 | −22.5 | −22.5 |
| Freezing point, ° C. | | −26 | −24 | −24 |
| Iodine value, mgKOH/g | | 0.06 | 0.06 | 0.04 |
| Aniline point, ° C. | | 118.5 | 118.6 | 119.0 |
| Distillation properties, ° C. | IBP, ° C. | 361 | 360 | 362 |
| | T10, ° C. | 399 | 400 | 401 |
| | T50, ° C. | 435 | 436 | 437 |
| | T90, ° C. | 461 | 465 | 464 |
| | FBP, ° C. | 490 | 491 | 489 |
| RPVOT (150° C.), min | | 425 | 433 | 442 |
| NOACK (250° C., 1 h), mass % | | 14.9 | 14.3 | 13.8 |
| CCS viscosity (−35° C.), mPa · s | | 1,450 | 1,420 | 1,480 |
| BF viscosity (−40° C.), mPa · s | | — | 875,000 | 882,000 |
| Residual metals | Al, ppm by mass | <1 | <1 | <1 |
| | Mo, ppm by mass | <1 | <1 | <1 |
| | Ni, ppm by mass | <1 | <1 | <1 |
| MRV viscosity (−40° C.), mPa · s | 0.3% by mass Pour point depressant | 6,200 | 5,700 | 5,700 |
| | 0.5% by mass Pour point depressant | 6,000 | 5,750 | 5,750 |
| | 1.0% by mass Pour point depressant | 6,700 | 6,000 | 6,000 |

Examples 1-7, Comparative Examples 1-8

For Examples 1-7 there were prepared lubricating oil compositions having the constituents shown in Table 5, using base oil 1-1, base oil 1-2 or base oil 1-3, and the base oils and additives listed below. For Comparative Examples 1-8 there were prepared lubricating oil compositions having the constituents shown in Tables 6 and 7, using the base oils and additives listed below. The properties of the obtained lubricating oil compositions are shown in Tables 5-7.

(Base Oils)

Base oil 2: Paraffinic hydrotreated base oil (saturated components content: 94.8% by mass, proportion of cyclic saturated components among saturated components: 46.8% by mass, sulfur content: <0.001% by mass, kinematic viscosity at 100° C.: 4.1 $mm^2/s$, viscosity index: 121, refractive index at 20° C.: 1.4640, $n_{20}$-0.002×kv100: 1.456)

Base oil 3: Paraffinic highly refined base oil (saturated components content: 99.7% by mass, sulfur content: 0.01% by mass, kinematic viscosity at 100° C.: 4.0 $mm^2/s$, viscosity index: 125)

Base oil 4: Paraffinic solvent refined base oil (saturated components content: 77% by mass, sulfur content: 0.12% by mass, kinematic viscosity at 100° C.: 4.0 $mm^2/s$, viscosity index: 102)

(Ash-Free Antioxidants Containing No Sulfur as a Constituent Element)

A1: Alkyldiphenylamine

A2: Octyl-3-(3,5-di-tert-butyl-4-hydroxyphenyl)propionate (Ash-Free Antioxidant Containing Sulfur as a Constituent Element and Organic Molybdenum Compound)

B1: Ash-free dithiocarbamate (sulfur content: 29.4% by mass)

B2: Molybdenum ditridecylamine complex (molybdenum content: 10.0% by mass)

(Anti-Wear Agent)

C1: Zinc dialkyldithiophosphate (phosphorus content: 7.4% by mass, alkyl group: primary octyl group)

C2: Zinc dialkyldithiophosphate (phosphorus content: 7.2% by mass, alkyl group: mixture of secondary butyl group or secondary hexyl group)

(Ash-Free Dispersant)

D1: Polybutenyl succiniimide (bis type, weight-average molecular weight: 8,500, nitrogen content: 0.65% by mass)

(Ash-Free Friction Modifier)

E1: Glycerin fatty acid ester (trade name: MO50 by Kao Corp.)

(Other Additives)

F1: Package containing metal-based detergent, viscosity index improver, pour point depressant and antifoaming agent.

[Heat and Oxidation Stability Evaluation Test]

The lubricating oil compositions obtained in Examples 1-7 and Comparative Examples 1-8 were subjected to a heat and oxidation stability test according to the method described in JIS K 2514, Section 4 (ISOT) (test temperature: 165.5° C.), and the base number retentions after 24 hours and 72 hours were measured. The results are shown in Tables 5-7.

[Frictional Property Evaluation Test: SRV (Small Reciprocating Wear) Test]

The lubricating oil compositions according to Examples 1-7 and Comparative Examples 1-8 were subjected to an SRV test in the following manner, and the frictional properties were evaluated. First, a test piece (steel ball (diameter: 18 mm)/disk, SUJ-2) was prepared for an SRV tester by Optimol Co., and it was finished to a surface roughness of Ra 0.2 μm. The test piece was mounted in the SRV tester by Optimol Co., and each lubricating oil composition was dropped onto the sliding surface of the test piece and tested under conditions with a temperature of 80° C., a load of 30N, an amplitude of 3 mm and a frequency of 50 Hz, measuring the mean frictional coefficient from the period between 15 minutes and 30 minutes after start of the test. The results are shown in Tables 5-7.

TABLE 5

| | | Example | | | | | | |
|---|---|---|---|---|---|---|---|---|
| | | 1 | 2 | 3 | 4 | 5 | 6 | 7 |
| Lubricating base oil constituent | Base oil 1-1 | 100 | — | — | 50 | 50 | 50 | 100 |
| | Base oil 1-2 | — | 100 | — | — | — | — | — |
| | Base oil 1-3 | — | — | 100 | — | — | — | — |
| | Base oil 2 | — | — | — | 50 | — | — | — |
| | Base oil 3 | — | — | — | — | 50 | — | — |
| | Base oil 4 | — | — | — | — | — | 50 | — |
| Lubricating oil composition constituent | Base oil | remainder | remainder | remainder | remainder | remainder | remainder | remainder |
| | A1 | 0.8 | 0.8 | 0.8 | 0.8 | 0.8 | 0.8 | 0.8 |
| | A2 | — | — | — | 0.4 | 0.4 | 0.4 | — |
| | B1 | — | — | — | — | — | — | 0.3 |
| | B2 (in terms of Mo) | (0.02) | (0.02) | (0.02) | (0.02) | (0.02) | (0.02) | — |
| | C1 | 0.1 | 0.1 | 0.1 | 0.1 | 0.1 | 0.1 | 0.1 |
| | C2 | 0.5 | 0.5 | 0.5 | 0.5 | 0.5 | 0.5 | 0.5 |
| | D1 | 4.0 | 4.0 | 4.0 | 4.0 | 4.0 | 4.0 | 4.0 |
| | E1 | 0.5 | 0.5 | 0.5 | 0.5 | 0.5 | 0.5 | 0.5 |
| | F1 | 10.0 | 10.0 | 10.0 | 10.0 | 10.0 | 10.0 | 10.0 |
| Sulfur content, % by mass | | 0.12 | 0.12 | 0.12 | 0.13 | 0.13 | 0.45 | 0.20 |
| Phosphorus content, % by mass | | 0.04 | 0.04 | 0.04 | 0.04 | 0.04 | 0.04 | 0.04 |
| Kinematic viscosity at 100° C., $mm^2/s$ | | 10.1 | 10.1 | 10.1 | 10.1 | 10.1 | 10.2 | 10.1 |
| Acid number, mgKOH/g | | 2.4 | 2.4 | 2.4 | 2.4 | 2.4 | 2.4 | 2.4 |
| Base number, mgKOH/g | | 5.9 | 5.9 | 5.9 | 5.9 | 5.9 | 5.9 | 5.9 |
| Heat/oxidation stability | After 24 h | 74.5 | 78.8 | 80.2 | 73.5 | 72.8 | 74.1 | 80.2 |
| | After 72 h | 55.2 | 56.7 | 57.2 | 48.5 | 47.3 | 46.9 | 56.1 |
| Friction property | After 24 h | 0.055 | 0.061 | 0.062 | 0.064 | 0.067 | 0.063 | 0.059 |
| | After 72 h | 0.088 | 0.079 | 0.084 | 0.092 | 0.091 | 0.095 | 0.086 |
| CCS viscosity, mPa · s (−35° C.) | | 2,830 | 2,990 | 3,020 | 4,050 | 4,120 | 4,070 | 2,780 |
| CCS viscosity, mPa · s (After 72 h) | | 3,450 | 3,800 | 3,620 | 4,300 | 4,720 | 4,680 | 3,590 |
| MRV viscosity, mP · s (−40° C.) | | 5,600 | 6,050 | 5,950 | 8,200 | 7,950 | 8,100 | 6,200 |
| MRV viscosity, mP · s (After 72 h) | | 11,900 | 12,800 | 12,500 | 17,100 | 16,800 | 15,500 | 11,800 |

TABLE 6

| | | Comp. Ex. | | | | |
|---|---|---|---|---|---|---|
| | | 1 | 2 | 3 | 4 | 5 |
| Lubricating base oil constituent | Base oil 1-1 | — | — | — | — | — |
| | Base oil 1-2 | — | — | — | — | — |
| | Base oil 1-3 | — | — | — | — | — |
| | Base oil 2 | 100 | 100 | 100 | 100 | 100 |
| | Base oil 3 | — | — | — | — | — |
| | Base oil 4 | — | — | — | — | — |
| Lubricating oil composition constituent | Base oil | remainder | remainder | remainder | remainder | remainder |
| | A1 | 0.8 | 0.8 | 0.8 | 0.8 | — |
| | A2 | — | 0.5 | | — | — |
| | B1 | — | — | 0.3 | — | — |
| | B2 | — | (0.02) | (0.02) | (0.02) | — |
| | C1 | 0.1 | 0.1 | 0.1 | 0.1 | 0.1 |
| | C2 | 0.5 | 0.5 | 0.5 | 0.5 | 0.5 |
| | D1 | 4.0 | 4.0 | 4.0 | 4.0 | 4.0 |

TABLE 6-continued

| | | Comp. Ex. | | | | |
|---|---|---|---|---|---|---|
| | | 1 | 2 | 3 | 4 | 5 |
| | E1 | 0.5 | 0.5 | 0.5 | 0.5 | 0.5 |
| | F1 | 10.0 | 10.0 | 10.0 | 10.0 | 10.0 |
| Sulfur content, % by mass | | 0.14 | 0.14 | 0.22 | 0.14 | 0.12 |
| Phosphorus content, % by mass | | 0.043 | 0.043 | 0.043 | 0.043 | 0.043 |
| Kinematic viscosity at 100° C., $mm^2/s$ | | 9.9 | 9.9 | 9.9 | 9.9 | 9.9 |
| Acid number, mgKOH/g | | 2.4 | 2.4 | 2.4 | 2.4 | 2.4 |
| Base number, mgKOH/g | | 5.9 | 5.9 | 5.9 | 5.9 | 5.9 |
| Heat/oxidation stability | After 24 h | 61.2 | 62.5 | 60.3 | 62.2 | 48.5 |
| | After 72 h | 46.8 | 50.2 | 48.8 | 49.2 | 28.5 |
| Friction property | After 24 h | 0.078 | 0.082 | 0.079 | 0.083 | 0.088 |
| | After 72 h | 0.118 | 0.109 | 0.125 | 0.117 | 0.133 |
| CCS viscosity, mPa · s (−35° C.) | | 5,800 | 5,750 | 5,920 | 5,830 | 5,980 |
| CCS viscosity, mPa · s (After 72 h) | | 9,200 | 10,560 | 9,800 | 11,020 | 9,360 |
| MRV viscosity, mP · s (−40° C.) | | 18,800 | 19,400 | 20,200 | 19,600 | 20,100 |
| MRV viscosity, mP · s (After 72 h) | | 39,300 | 42,500 | 46,300 | 41,600 | 43,200 |

TABLE 7

| | | Comp. Ex. | | |
|---|---|---|---|---|
| | | 6 | 7 | 8 |
| Lubricating base oil constituent | Base oil 1-1 | — | — | — |
| | Base oil 1-2 | — | — | — |
| | Base oil 1-3 | — | — | — |
| | Base oil 2 | 50 | — | 50 |
| | Base oil 3 | 50 | 50 | — |
| | Base oil 4 | — | 50 | 50 |
| Lubricating oil composition constituent | Base oil | remainder | remainder | remainder |
| | A1 | 0.8 | 0.8 | 0.8 |
| | A2 | — | — | — |
| | B1 | 0.3 | 0.3 | 0.3 |
| | B2 | (0.02) | (0.02) | (0.02) |
| | C1 | 0.1 | 0.1 | 0.1 |
| | C2 | 0.5 | 0.5 | 0.5 |
| | D1 | 4.0 | 4.0 | 4.0 |
| | E1 | 0.5 | 0.5 | 0.5 |
| | F1 | 10.0 | 10.0 | 10.0 |
| Sulfur content, % by mass | | 0.14 | 0.14 | 0.14 |
| Phosphorus content, % by mass | | 0.043 | 0.043 | 0.043 |
| Kinematic viscosity at 100° C., $mm^2/s$ | | 10.0 | 10.0 | 10.0 |
| Acid number, mgKOH/g | | 2.4 | 2.4 | 2.4 |
| Base number, mgKOH/g | | 5.9 | 5.9 | 5.9 |
| Heat/oxidation stability | After 24 h | 61.8 | 58.5 | 57.3 |
| | After 72 h | 47.5 | 41.8 | 42.2 |
| Friction property | After 24 h | 0.077 | 0.075 | 0.077 |
| | After 72 h | 0.118 | 0.119 | 0.122 |
| CCS viscosity, mPa · s (−35° C.) | | 5,800 | 6,500 | 6,200 |
| CCS viscosity, mPa · s (After 72 h) | | 9,200 | 13,460 | 12,800 |
| MRV viscosity, mP · s (−40° C.) | | 18,800 | 22,300 | 24,100 |
| MRV viscosity, mP · s (After 72 h) | | 39,300 | 58,400 | 56,800 |

From Tables 5-7 it is seen that the heat and oxidation stabilities, frictional properties and low-temperature viscosity characteristics of the lubricating oil compositions for an internal combustion engine of Examples 1-7 were superior to Comparative Examples 1-8.

The invention claimed is:

1. A lubricating oil composition for an internal combustion engine comprising:

a lubricating base oil having a urea adduct value of not greater than 4% by mass and a viscosity index of 100 or greater;

an ash-free antioxidant containing no sulfur as a constituent element; and at least one compound selected from among ash-free antioxidants containing sulfur as a constituent element and organic molybdenum compounds.

2. A lubricating oil composition for an internal combustion engine according to claim 1, wherein the lubricating base oil is a lubricating base oil obtained by hydrocracking/hydroisomerizing a feedstock oil containing normal paraffins so as to obtain a treated product having a urea adduct value of not greater than 4% by mass and a viscosity index of 100 or higher.

3. A lubricating oil composition according to claim 2, wherein the feedstock oil comprises at least 50% by mass of slack wax obtained by solvent dewaxing of a lubricating base oil.

* * * * *